United States Patent [19]

Miyoshi et al.

[11] Patent Number: 5,058,874

[45] Date of Patent: Oct. 22, 1991

[54] AUTOMATIC DOCUMENT CONVEYING DEVICE

[75] Inventors: Jun Miyoshi; Hiroyuki Nagai, both of Osaka; Mitsugu Shibanaka, Sakai; Nobukazu Otsuka, Osaka; Yasuhiko Kida, Sakai; Haruo Yamamoto, Osaka; Toshikazu Matsui, Kishiwada, all of Japan

[73] Assignee: Mita Industrial Co. Ltd., Osaka, Japan

[21] Appl. No.: 322,914

[22] Filed: Mar. 14, 1989

[30] Foreign Application Priority Data

Mar. 12, 1988 [JP] Japan ..... 63-174135
Mar. 15, 1988 [JP] Japan ..... 63-61333

[51] Int. Cl.[5] ..... B65H 5/22

[52] U.S. Cl. ..... 271/4; 271/10; 271/116; 271/117

[58] Field of Search ..... 271/3, 4, 6, 7, 10, 271/114, 116, 117, 118, 119, 122, 225, 258, 259, 263, 265, 266, 184, 902; 355/321, 322, 308, 309, 313

[56] References Cited

U.S. PATENT DOCUMENTS 4,565,462 1/1986 Yamamoto et al. ..... 271/902 X
4,610,533 9/1986 Takahata ..... 271/6 X
4,632,376 12/1986 DuBois ..... 271/4
4,761,001 8/1988 Hayakawa et al. ..... 271/902 X

FOREIGN PATENT DOCUMENTS 201644 8/1988 Japan ..... 355/321

*Primary Examiner*—David H. Bollinger
*Attorney, Agent, or Firm*—Antonelli, Terry, Stout & Kraus

[57] ABSTRACT

An automatic document conveying device for use with an image processing machine having a transparent plate on which to place documents. The device includes an opening-closing frame and a document table. A conveyor roller is rotatably mounted in the opening-closing frame. A document delivery device is provided for delivering sheet-like documents from the document table. The document delivered from the document table is introduced into a required position on the transparent plate by the conveyor roller. The rotation of the conveyor roller in the introducing direction is stopped while the introduced document is still between the conveyor roller and the transparent plate. A guiding device which permits advance of the document from the document table to the transparent plate but hampers movement of the document from the transparent plate toward the document table and defects it upwardly, is provided between the document table and the conveyor roller. When the conveyor roller is rotated in the carrying direction, the document on the transparent plate is deflected upwardly by the guiding device and discharged through a discharge opening formed in the opening-closing frame.

41 Claims, 11 Drawing Sheets

2
4
6
10
12
14
16
16
18
19
84
86
88
90
92
98
100
ND
PS
CK
AEK
MC2
MC1
MD
NK2
NK1

FIG. 14-A
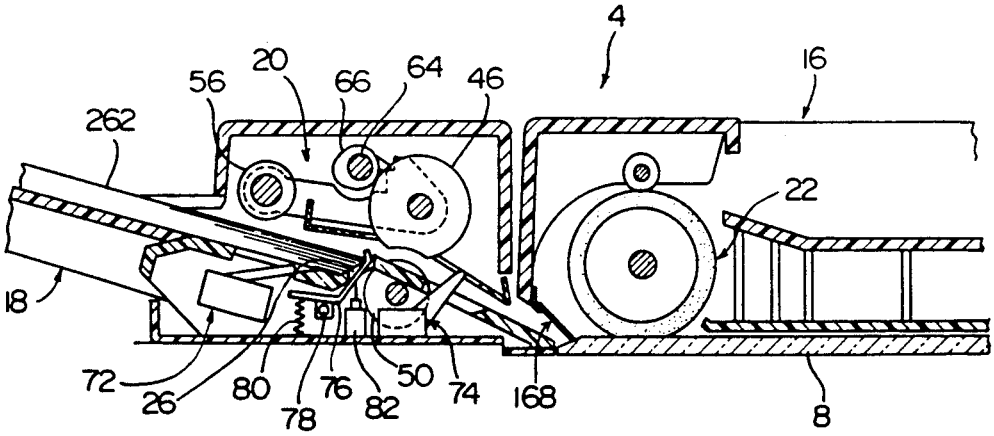
FIG. 14-B
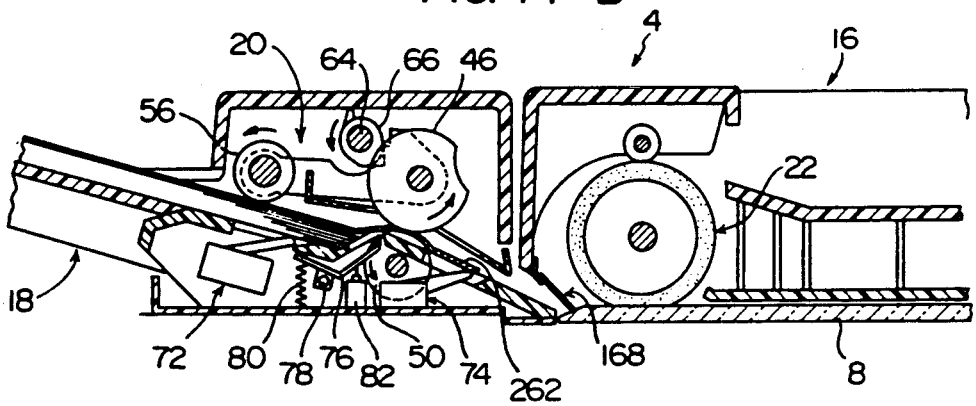

FIG. 14-C
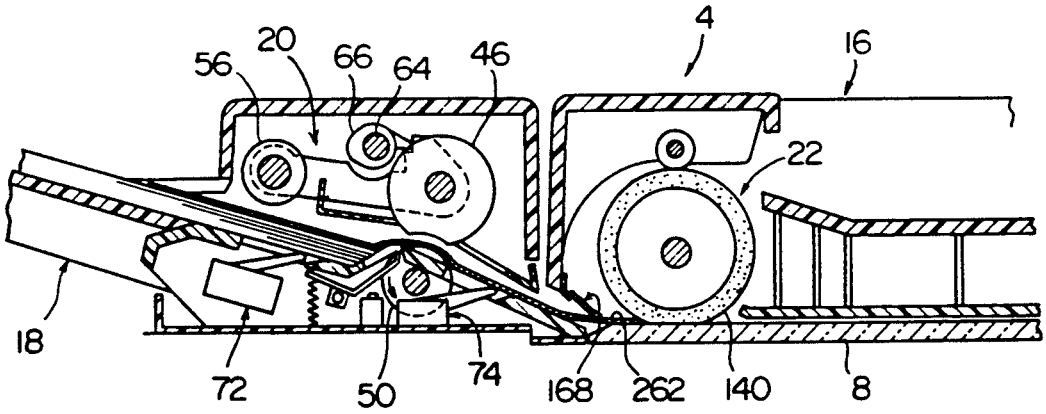
FIG. 14-D
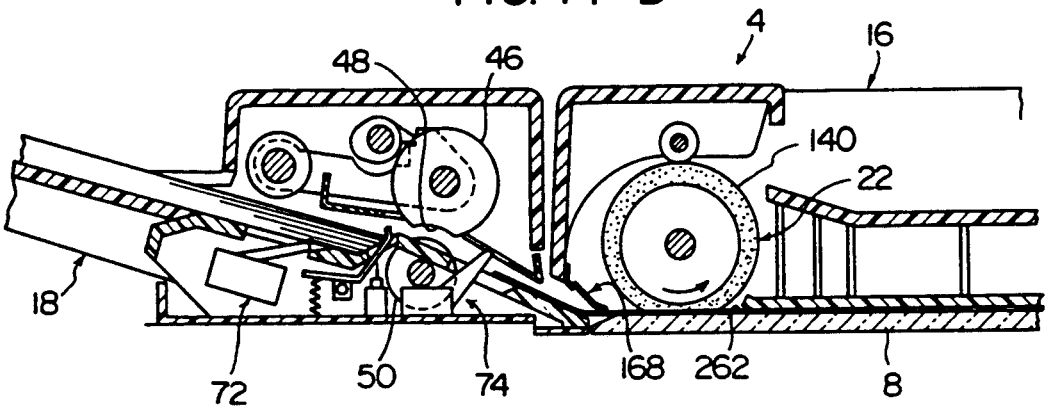

FIG. 14-E
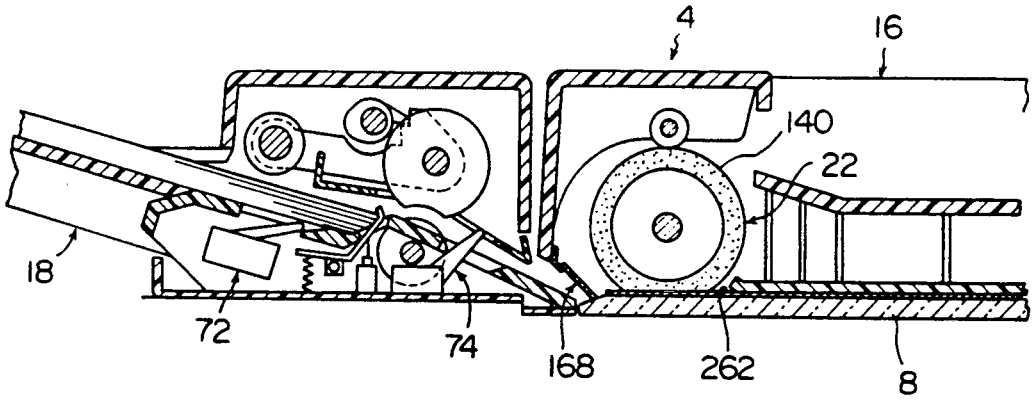
FIG. 14-F
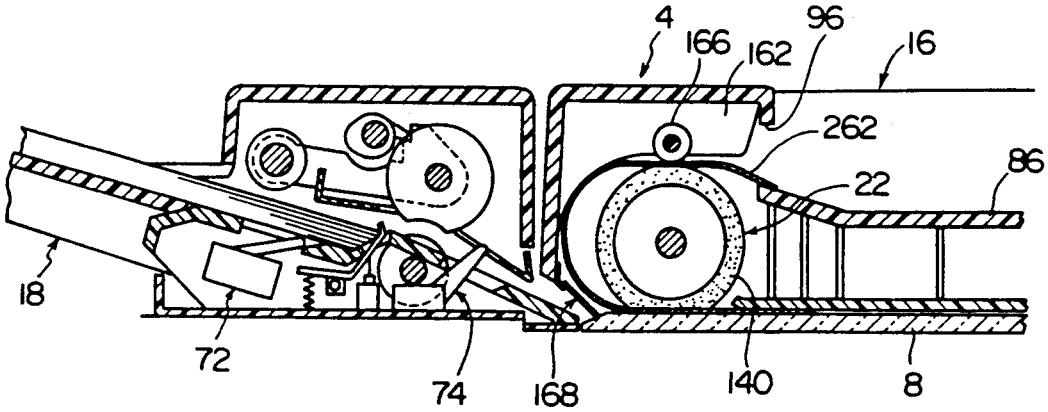

AUTOMATIC DOCUMENT CONVEYING DEVICE

FIELD OF THE INVENTION

This invention relates to an automatic document conveying device for use with an image processing machine such as an electrostatic copying machine, and to various elements used in it.

DESCRIPTION OF THE PRIOR ART

To automatic handling of a document in a copying operation or the like, it has been the widespread practice to install an automatic document conveying device in an image processing machine such as an electrostatic copying machine. A typical example of the automatic document conveying device is disclosed in Japanese Laid-Open Patent Publication No. 118551/1985.

The above automatic conveying device includes an opening-closing frame and a document table. A transparent plate on which to place a document to be copied is disposed on the upper surface of the housing of the image processing machine. The opening-closing frame is mounted on the housing so as to be free to pivot around a pivot axis extending along one edge of the transparent plate as a center between a closed position at which it covers the transparent plate and an open position at which is exposes the transparent plate to view. The document table is mounted on the housing adjacent to the opening-closing frame. A document delivery means for delivering a plurality of sheet-like documents on the table one by one is annexed to the document table. A document conveying means is annexed to the opening-closing frame to convey the document delivered from the document table to a required position on the transparent plate, and after scanning of the document, transfer it to the upper surface of the opening-closing frame. The document conveying means comprises a conveyor belt mechanism extending along the transparent plate.

In operation, the opening-closing frame of the automatic document conveying device is held at the closed position and sheet-like documents are placed in a stacked state on the document table. Then, the operation of the automatic document conveying device is started. One document is then delivered from the document table by the document delivery means, and conveyed to a required position on the transparent plate by the document conveying means. When the scanning of the conveyed document is over, the document is transferred to the upper surface of the opening-closing frame from the transparent plate by the document conveying means. The next document is then delivered from the document table by the document delivery means.

The aforesaid conventional automatic document conveying device is relatively complex and expensive owing to the structure of the document conveying means including the conveyor belt mechanism. Accordingly, it is unsuitable for a relatively inexpensive low- to medium-grade image processing machines.

SUMMARY OF THE INVENTION

It is a primary object of this invention to provide a novel and improved automatic document conveying device which comprises a document conveying means of a simplified structure annexed to the opening-closing frame, is relatively low in the cost to build, and can therefore be applied conveniently to relatively inexpensive low- to medium-grade image processing machines.

Another object of this invention is to improve an automatic document conveying device including a document conveying means of a simplified structure annexed to the opening-closing frame, in various respects in the structures of the constituent elements and in the control system for various actions of the device so as to permit precise and stable actions.

Still another object of this invention is to provide various improved constituent elements which can, although not exclusively, be used conveniently in an automatic document conveying device including a document conveying means of a simplified structure annexed to the opening-closing frame.

According to one aspect of the invention, a conveyor roller means is rotatably mounted on the opening-closing frame. When the opening-closing frame is held at the closed position, the conveying roller means is brought into intimate contact with the transparent plate disposed on the upper surface of the housing of the image processing machine. The leading edge of a document delivered from the document table by the document delivery means abuts with the intimately contacting site between the conveyor roller means out of action and the transparent plate, and when the leading edge of the document is inclined in the widthwise direction, the inclination is corrected. Then, the conveyor roller means is rotated in the conveying direction and the document is conveyed to a required position on the transparent plate. The rotation of the conveyor roller means in the conveying direction is stopped while the conveyed document is still nipped between the conveyor roller means and the transparent plate. Between the document table and the conveyor roller means is disposed a guiding means which permits advance of the document from the document table to the transparent plate, but hampers movement of the document from the transparent plate toward the document table and deflects it upwardly. The guiding means is comprised of a flexible thin piece projecting downwardly inclinedly toward the downstream side as viewed in the document delivering direction, and a plurality of cuts are formed at intervals in the thin piece in the widthwise direction. A discharge opening is formed in the opening-closing frame in relation to the conveyor roller means and the guiding means. When the scanning of the document conveyed onto the transparent plate is over, the conveyor roller means is rotated in the reverse direction, and the scanned document is conveyed onto the opening-closing frame through the discharge opening while being deflected upwardly by the guiding means. The rotation stop time of the conveyor roller means in the conveying direction is set according to the length of the document. The opening-closing frame is mounted so that its mounting height can be adjusted freely by a mounting mechanism having an adjusting screw. The opening or closing movement of the opening-closing frame is detected by a safety switch means whose detecting characteristics are maintained unchanged even when its mounting height is changed.

BRIEF DESCRIPTION OF THE DRAWINGS

FIGS. 14-A to 14-F are partial sectional views illustrating the operating procedure of the automatic document conveying device of FIG. 1;

DETAILED DESCRIPTION OF PREFERRED EMBODIMENTS

With reference to the accompanying drawings, preferred embodiments of the automatic document conveying device of the invention will be described in detail.

General Structure

Figure 1:
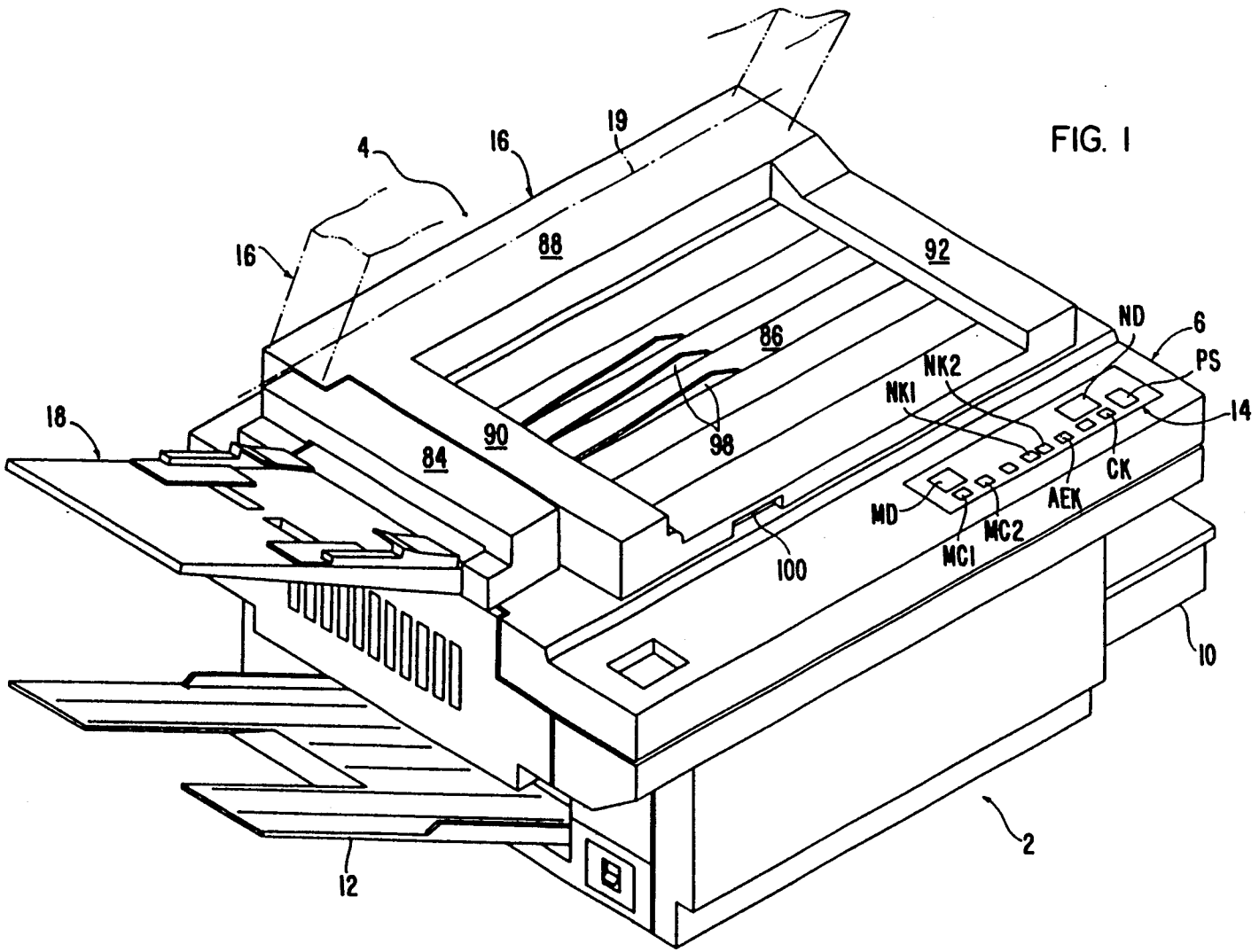
FIG. 1 is a perspective view of an electrostatic copying machine equipped with a preferred embodiment of the automatic document conveying device constructed in accordance with this invention.

FIG. 1 shows an electrostatic copying machine shown generally at 2 and an automatic document conveying device shown generally at 4. The electrostatic copying machine 2 of a known type is provided with a nearly parallelepiped housing 6, and a transparent, usually rectangular, plate 8 (FIGS. 2 and 3) on which to place documents with their surface to be copied down is disposed centrally on the upper surface of the housing 6. A paper cassette 10 holding a plurality of copying paper sheets is detachably mounted on one side of the housing 6, and a receiving tray 12 is mounted on the other side of the housing 6. An operating panel 14 (which will be described further later on) having a plurality of operating switches and displays, is provided in one side portion of the front end of the upper surface of the housing 6. Various constituent elements including a rotating drum having an electrostatographic layer on its surface are disposed within the housing 6, although they are not shown. A toner image is formed on the rotating drum by an image-forming step including document scanning and exposure involving optically scanning the document placed on the transparent plate 8 (FIGS. 2 and 3), and projecting a reflected image of the document onto the rotating drum. The toner image is transferred to a copying paper sheet fed from the paper cassette, and the copying paper sheet having the toner image transferred and fixed is then discharged onto the receiving tray 12.

The illustrated automatic document conveying device 4 of the invention includes an opening-closing frame 16 and a stationary document table 18. The opening-closing frame 16 is mounted pivot between a closed position shown by a solid line in FIG. 1 and an open position shown partly in a simplified manner by a two-dot chain line in FIG. 1. Frame 16 is mounted pivotably about a pivot axis 19 extending along the rear edge of the transparent plate 8, or more specifically parallel to, and slightly rearwardly and upwardly of, the rear edge of the transparent plate 8 (the manner of mounting the opening-closing frame 16 will be described hereinafter). When the opening-closed frame 16 is held at the closing position, the transparent plate 8 is covered with the opening-closing frame 16, and when it is held at the open position, the transparent plate 8 is exposed to view. When a document to be copied is placed on the transparent plate 8 by hand, it is necessary to operate the opening-closing frame 16 by hand.

The document table 18 is mounted on the housing 6 adjacent to one side (the left side as viewed from the front) of the opening-closing frame 16. As will be described in detail hereafter, a document delivery means 20 (FIGS. 2 and 3) is annexed to the document table 18, and a conveyor roller means 22 (FIGS. 2 and 3) is annexed to the opening-closing frame 16. The document delivery means 20 delivers documents on the document table 18 one by one toward the transparent plate 8. The conveying roller means 22 introduces the delivered document into a required position on the transparent plate 8 and carries the scanned document from the transparent plate 8 to the upper surface of the opening-closing frame 16.

Document Table and Document Delivery Means

Figure 2:
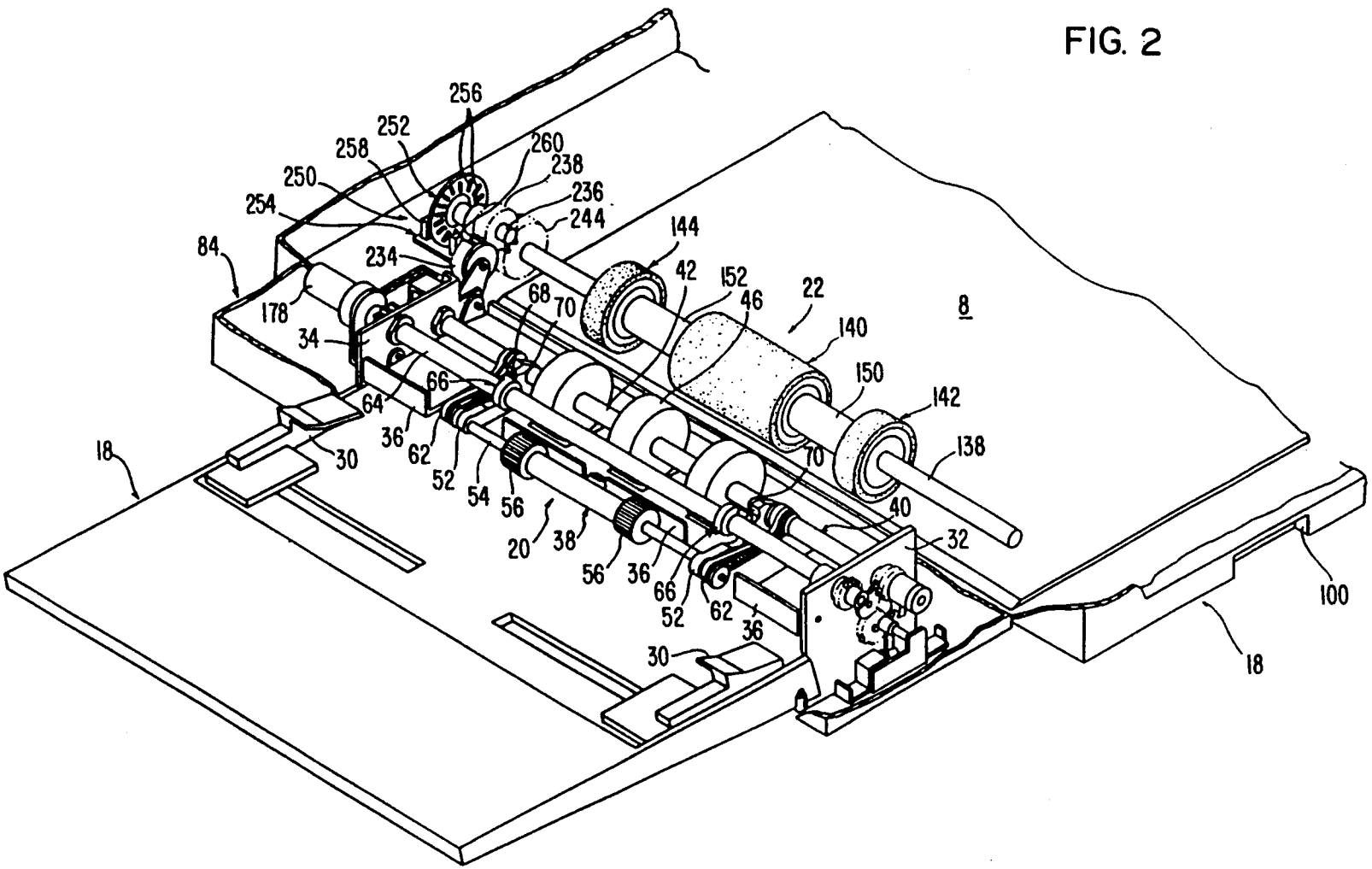
FIG. 2 is a partially cut-away view of the automatic document conveying device of FIG. 1.
Figure 3:
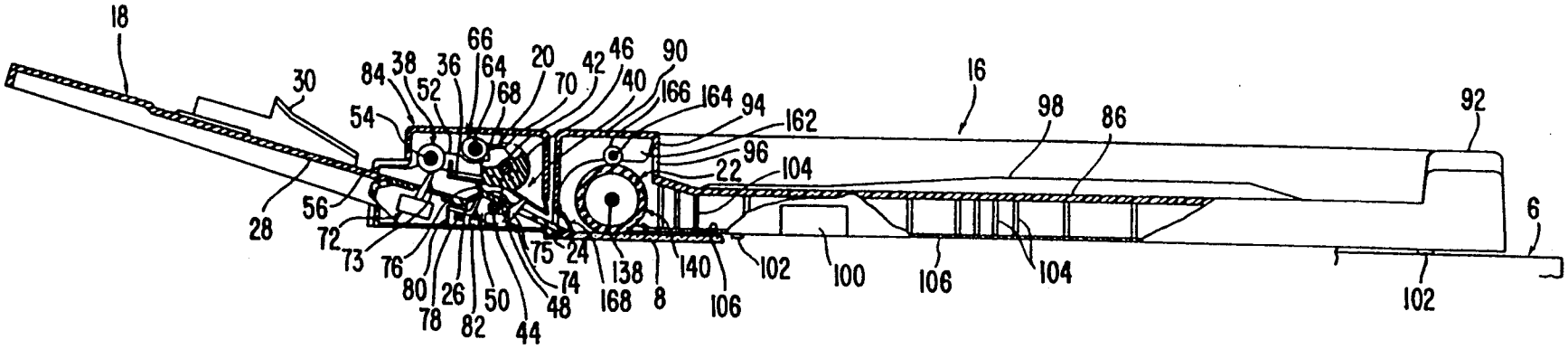
FIG. 3 is a section view of the automatic document conveying device of FIG. 1.

With reference to FIGS. 2 and 3, the document table 18 may be made of a synthetic resin, and extends to the left from its downstream end which is in proximity to or in contact with the left side edge of the transparent plate 8. The document table 18 is mounted on the housing 6 by fixing its downstream portion to the wall of the upper surface of the housing 6 by screwing or otherwise. As clearly shown in FIG. 3, the document table 18 has an inclined downstream portion 24 extending from the aforesaid downstream end in an upwardly inclined manner toward the left, a short oppositely inclined portion 26 inclined in the opposite direction, namely in a downwardly inclined manner toward the left, and a main portion 28 extending from the oppositely inclined portion 26 in an upwardly inclined manner toward the left. A greater part of the main portion 28 projects to the left beyond the housing 6 of the electrostatic copying machine 2. As shown in FIG. 2, a pair of width restricting members 30 are mounted on the main portion 28 of the document table 18. The pair of width restricting members 30, which may be of a known type, are free to move toward and away from each other, and the distance between the two is set by hand at a length corresponding to the width of the document placed on the document table 18. As shown clearly in FIG. 2, a front upstanding plate 32 and a rear upstanding plate 34 are disposed on both sides of the downstream portion of the document table 18. Between the front upstanding plate 32 and the rear upstanding plate 34 is disposed an upper guide plate 36 extending above the downstream portion of the document table 18.

Figure 4:
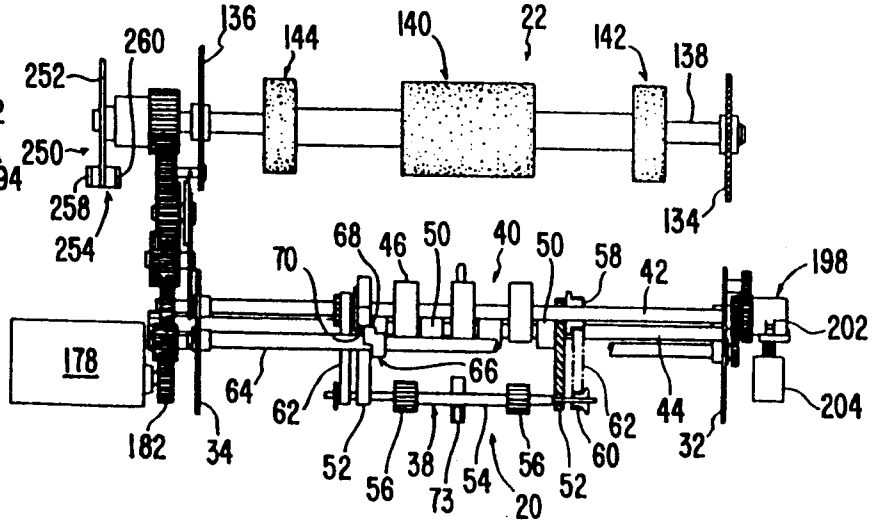
FIG. 4 is a simplified top plan view showing a driving system in the automatic document conveying device of FIG. 1.

A delivery roller mechanism 38 and a separating roller mechanism 40 are further provided between the front upstanding plate 32 and the rear upstanding plate 34. The delivery roller mechanism 38 and the separation roller mechanism 40 constitute the document delivery means 20. With reference to FIG. 4 in conjunction with FIGS. 2 and 3, an upper rotating shaft 42 and a lower rotating shaft 44 are rotatably mounted at a predetermined vertical interval between the front upstanding plate 32 and the rear upstanding plate 34. Three feed rollers 46 are fixed at suitable intervals in the axial direction to the upper rotating shaft 42. The feed rollers 46, which may be formed of a suitable material such as synthetic rubber, project downwardly through an opening formed in the upper guide plate 36. It will be seen by reference to FIG. 3 that the peripheral surfaces of the feed rollers are not completely circular, and a nearly crescent cut 48 is formed at a specific angular site on the feed rollers 46.

Four reverse-rotating rollers 50 are fixed at suitable intervals in the axial direction to the lower rotating shaft 44. The reverse-rotating rollers 50, which may be formed of a suitable material such as synthetic rubber, project upwardly through an opening formed in the inclined downstream portion 24 of the document table 18. It is seen from FIG. 4 that the feed rollers 46 and the reverse-rotating rollers 50 are alternately arranged in the axial direction (i.e., the left-right direction in FIG. 4), and each of the feed rollers 46 is disposed between the adjacent reverse-rotating rollers 50.

Base end portions of a pair of supporting arms 52 are pivotally mounted on the upper rotating shaft 42. The pair of supporting arms 52 extend to the left in FIG. 3, and a rotating shaft 54 is rotatably mounted across the free end portions of these supporting arms 52. Two delivery rollers 56 are fixed to the rotating shaft 54 at a suitable interval in the axial direction. The delivery rollers 56 may be formed of a suitable material such as synthetic rubber.

Toothed pulleys 58 are also fixed to the upper rotating shaft 42 at positions adjacent to the base end portions of the pair of supporting arms 52. Corresponding to the toothed pulleys 58, toothed pulleys 60 are fixed also to both end portions of the rotating shaft 54, and a timing belt 62 is wrapped over each of the toothed pulleys 58 and each of the toothed pulleys 60. Accordingly, when the upper rotating shaft 42 is rotated counterclockwise in FIG. 3 in the manner to be described (during which the lower rotating shaft 44 is rotated counterclockwise in FIG. 3), the rotation of the upper rotating shaft 42 is transmitted to the rotating shaft 54 via the toothed pulleys 58, the timing belts 62 and the toothed pulleys 60, and the rotating shaft 54 is also rotated counterclockwise in FIG. 3.

A cam shaft 64 is rotatably mounted between the front upstanding plate 32 and the rear upstanding plate 34. A pair of cams 66 are fixed to the cam shaft 64 corresponding to the pair of supporting arms 52. The cams 66 each have an actuating protrusion 68. On the other hand, a flat restrained surface 70 is formed in the base end portions of the pair of supporting arms 52. When the cams 66 are held at the restraining positions shown in FIGS. 2 and 3, the actuating protrusions 68 of the cams 66 engage the restrained surfaces 70 of the supporting arms 52 to restrain the supporting arms 52 at the elevated positions shown in FIGS. 2 and 3 when the supporting arms 52 are restrained at the elevated positions, the delivery rollers 56 are lifted upwardly from the upper surface of the document table 18 by a predetermined distance. When the cam shaft 64 and the cams 66 fixed to it are rotated counterclockwise in FIG. 3 in the manner to be described, the actuating protrusions 68 of the cams 66 move away from the restrained surfaces 70 of the supporting arms 52. As a result, the pair of supporting arms 52 are pivoted counterclockwise in FIG. 3 around the upper rotating shaft 42 as a center owing to their own weight and the weight of the rotating shaft 54, etc. mounted across their free ends. Thus, the rotating shaft 54 and the delivery rollers 56 mounted on it are lowered and come into contact with the document placed on the document table 18 (see FIG. 14-B also). When the cam shaft 64 and the cams 66 fixed to it are rotated through one turn and returned to the restraining positions shown in FIGS. 2 and 3, the actuating protrusions 68 of the cams 66 act on the restrained surfaces 70 of the supporting arms 52 to return the supporting arms 52 to, and restrain them at, the elevated positions described above.

As clearly shown in FIG. 3, a set document detector 72 and a delivered document detector 74 are disposed in relation to the downstream portion (the right end portion in FIG. 3) of the document table 18. The set document detector 72 is comprised of a switch having a detecting arm 73 which projects upwardly through an opening formed centrally in the width direction in the downstream end portion of the main portion 28 of the document table 18. The delivered document detector 74 is also comprised of a switch having a detecting arm 75 which projects upwardly through an opening formed centrally in the width direction in the inclined downstream portion 24 of the document table 18.

A document restraining member 76 is further disposed in the illustrated document table 18. As shown clearly in FIG. 3, the document restraining member 76 is mounted pivotally about a pin 78 extending in the width direction (the direction perpendicular to the sheet surface in FIG. 3). A tension spring 80 and an electromagnetic solenoid 82 are also provided in the document restraining member 76 disposed centrally in the width direction. The tension spring 80 elastically biases the document restraining member 76 counterclockwise in FIG. 3, and elastically maintains it at an operative position shown in FIG. 3. When the document restraining member 76 is held at the operative position, its free end portion projects upwardly through an opening formed in the downstream end of the oppositely inclined portion 26 of the document table 18. When the electromagnetic solenoid 82 is energized, the document restraining member 76 is pivoted clockwise in FIG. 3 to a non-operative position against the elastic biasing action of the tension spring 80, and its free end portion is moved below the upper surface of the document table 18 (see FIG. 14-B also).

As clearly shown in FIGS. 1 and 3, a nearly box-like cover 84 having an open bottom is disposed in the downstream portion of the document table 18, and the delivery roller mechanism 38 and the separation roller mechanism 40 are covered with the cover 84 (a driving system to be described for the delivery roller mechanism 38 and the separation roller mechanism 40 are also covered with the cover 84).

Opening-Closing Frame

With reference to FIGS. 1 and 3, the opening-closing frame 16, which can be formed of a suitable synthetic resin, is generally box-like with an open bottom. As clearly shown in FIG. 1, a main portion 86 of the opening-closing frame 16 is depressed, and its upper surface is slightly lower than the upper surfaces of a rear edge portion 88, a left side edge portion 90 and a right side edge portion 92. As shown in FIG. 3, an elongate discharge opening 96 extending in the width direction (the direction perpendicular to the sheet surface in FIG. 3) is formed in a wall 94 extending downwardly from the right side edge of the upper surface of the left side edge portion 90 toward the upper surface of the main portion 86. The width of the discharge opening 96 corresponds to the width of the document table 18. As will be described in detail hereinafter, the document is discharged onto the upper surface of the main portion 86 through the discharge opening 96, and hence, the upper surface of the main portion 86 constitutes a document receiving surface.

Conveniently, a plurality of slender protrusions 98 extending in the document conveying direction (the left-right direction in FIG. 3) are formed at suitable intervals in the width direction on the upper surface of the main portion 86. As shown in FIG. 1, a depression 100 which can be held by fingers when opening or closing the opening-closing frame 16 is disposed in the front surface of the opening-closing frame 16. Furthermore, a pair of abutting protrusions 102 spaced from each other in the left-right direction in FIG. 3 extend from the lower end of the front surface of the opening-closing frame 16, as shown in FIG. 3. When the opening-closed frame 16 is held at the closing position shown in FIG. 3, the abutting protrusions 102 abut with the upper surface of the housing 6 of the electrostatic copying machine 2, whereby the closed position of the opening-closing frame 16 is regulated as is required.

A number of suspending columns 104 are formed integrally with the under surface of the main portion 86 of the opening closing frame 16, as shown in FIG. 3, and a plate member 106, which may be rectangular, is fixed to the lower ends of the suspending columns 104. When the opening-closing frame 16 is held at the closed position, the plate member 106 is positioned opposite to the transparent plate 8. In the left end portion of the plate member 106, a cut extending to the right by a predetermined length from the left end of the plate member 106 is formed corresponding to a roller, to be described later, in the conveyor roller means 22. The plate member 106 may be formed of a suitable synthetic resin, and its under surface is white in color. As will be described in detail hereinafter, the sheet-like document to be copied is introduced between the transparent plate 8 and the plate member 106 to introduce the document stably without being hampered by the plate member 106, it is convenient to provide a clearance of about 1.0 mm between the transparent plate 8 and the plate member 106 when the opening-closing frame 16 is at the closed position. The left end portion of the plate member 106 may be inclined slightly upwardly to the left.

Figure 5:
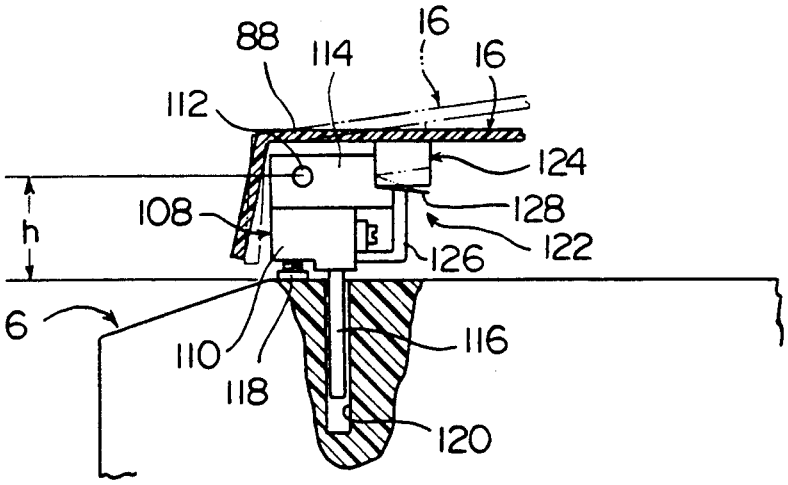
FIG. 5 is a partial sectional view showing the manner of mounting the opening-closing frame in the automatic document conveying device of FIG. 1.

As already stated with reference to FIG. 1, the opening-closing frame 16 must be mounted pivotally around the pivot axis 19. With reference to FIG. 5, a mounting mechanism shown generally at 108 may be utilized to mount the opening-closing frame 16. The illustrated mounting mechanism 108 includes a mounting member 110 and a pivot member 114 pivotally linked to the mounting member 110 via a pin 112. An insertion rod 116 extends downwardly from the under surface of the mounting member 110. The mounting mechanism 108, comprised of the mounting member 110 having the insertion rod 116 formed therein and the pivot member 114 linked pivotally to the mounting member 110 via the pin 112, is known to those skilled in the art and is generally available commercially. In the mounting mechanism 108 improved in accordance with this invention, an adjusting screw 118 is secured to the under surface of the mounting member 110 so that the degree of its screwing can be adjusted. To mount the opening-closing frame 16 by utilizing this mounting mechanism 108, the pivot member 114 of the mounting mechanism 108 is fixed to the inside surface of the rear edge portion 88 of the opening-closing frame 16 by a suitable method such as screwing. On the other hand, an insertion hole 120, extending downwardly from the upper surface of the housing 6, is formed in the housing 6. The insertion rod 116 extending from the mounting member 110 is inserted into the insertion hole 120, and the head of the adjusting screw 118 is caused to abut the upper surface of the housing 6. As a result, the opening-closing frame 16 is mounted on the housing 6 so that it is free to pivot about the pin 112 of the mounting mechanism 108. Hence, the central axis of the pin 112 constitutes the aforesaid pivot axis 19.

As already stated with reference to FIG. 3, it is important that in the illustrated embodiment, a clearance of about 1.0 mm exists between the transparent plate 8 and the plate member 106 when the opening-closing frame 16 is held at the closed position. To set the clearance precisely at the required value, it is important to adjust the thickness of the abutting protrusions 102, which are to abut with the upper surface of the housing 6 at the front edge of the opening-closing frame 16, precisely to a predetermined value and to adjust the mounting height at the rear edge of the opening-closing frame 16 (this mounting height can be shown, for example, by the distance h between the upper surface of the housing 6 and the pivot axis 19) precisely to a predetermined value. In the mounting mechanism 108 improved by the present invention, the mounting height h can be finely adjusted by properly controlling the degree of screwing of the adjusting screw 118 with respect to the mounting member 110. Specifically, the mounting height h can be increased when the degree of screwing is decreased and the amount of protrusion of the adjusting screw 118 from the under surface of the mounting member 110 is thereby increased. Conversely, when the degree of screwing is increased and the amount of protrusion of the adjusting screw 118 is thereby decreased, the mounting height h is decreased. To adjust the mounting height h in this manner, it is important that the insertion rod 114 extending from the mounting member 110 should be inserted into the insertion hole 120 formed in the housing 6 so as to be free to ascend and descend. To prevent the degree of screwing of the adjusting screw 118 from changing owing to vibration or otherwise, a check nut or the like may be combined with the adjusting screw 118 if required. Only one such mounting mechanism 108 may be used to mount the opening-closing frame 16, but desirably, two or more mounting mechanisms 108 are used at suitable intervals in the direction of the pivot axis 19.

With reference to FIG. 5, a safety switch means 122 is disposed in the illustrated embodiment in order to detect the opening and closing of the opening-closing frame 16. The safety switch means 122 is comprised of a combination of a switch element 124 and an actuating piece 126. The switch element 124 may be composed of a microswitch having a detecting arm 128, and is fixed to the inside surface of the rear edge portion 88 of the opening-closing frame 16. The actuating piece 126 is fixed to the side surface of the mounting member 110 in the mounting mechanism 108. When the opening-closed frame 16 is at the closing position shown by the solid line, the free end of the actuating piece 126 acts on the detecting arm 128 of the switch element 124 to close the switch element 124. When the opening-closing frame 16 is opened to a specific angular position shown by the two-dot chain line, the free end of the actuating piece 126 moves away from the detecting arm 128 to open the switch element 124. When the switch element 124 is opened, the actuation of the document delivery means 20 and the conveyor roller means 22 fails. In the above-described safety switch means 122, the actuation piece 126 is fixed to the mounting member 110 of the mounting mechanism 108. Hence, when the mounting member 110 is elevated or lowered by varying the degree of screwing of the adjusting screw 118, the actuating piece 126 is accordingly elevated or lowered. Thus, even when the mounting height of the opening-closing frame 16 is varied, the positional relationship between the switch element 124 and the actuating piece 126 remains the same, and the detecting characteristics of the safety switch means 122 (namely, the angular position of the opening-closing frame 16 when the switch element 124 is open) remain the same. It will be easily understood that if the actuating piece 126 is fixed to the housing 6 instead of fixing it to the mounting member 110 of the mounting mechanism 108, changing of the mounting height of the opening-closing frame 16 by varying the degree of screwing of the adjusting screw 118 results in a change in the relative positions of the switch element 124 and the actuating piece 126, and the detecting characteristics of the safety switch means 122 change. On the other hand, the detecting characteristics of the safety switch means 122 can be maintained the same even when as required, the switch element 124 is fixed to the pivot member 114 of the mounting mechanism 108 instead of the opening-closing frame 16, or the actuating piece 126 is fixed to the opening-closing frame 16 or the pivot member 114 and the switch element 124 is fixed to the mounting member 110.

Figure 6:
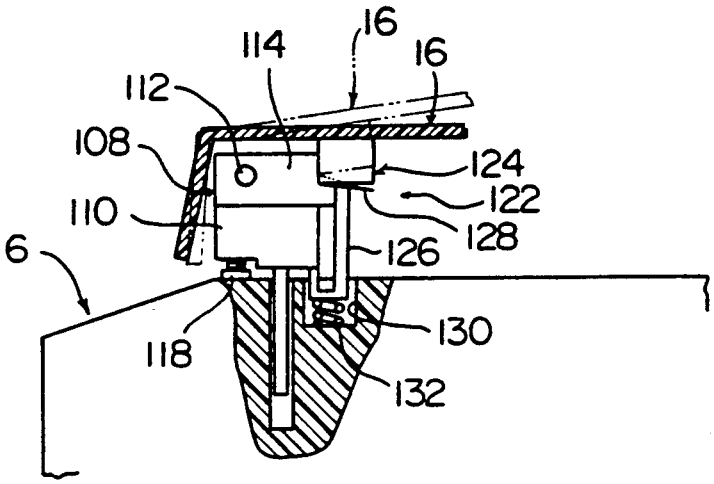
FIG. 6 is a partial sectional view showing a modified example of the manner of mounting the opening-closing frame.

FIG. 6 shows a modified example of the safety switch means 122. In this modified example, a depression 130 is formed in the upper surface of the housing 6, and a compression spring 132 together with the actuating piece 126 is received in the depression 130. The compression spring 132 elastically biases the actuating piece 126 upwardly and causes one end of the actuating piece 126 to abut the under surface of the mounting member 110. In this modified example, too, when the mounting member 110 is elevated or lowered by changing the degree of screwing of the adjusting screw 118, the actuating piece 126 is accordingly elevated or lowered. Hence, even when the mounting height of the opening-closing frame 16 changed, the relation between the switch element 124 and the actuating piece 126 is maintained the same, and the detecting characteristics of the safety switch means 122 are maintained the same.

The mounting mechanism 108 and the safety switch means 122 described above with reference to FIGS. 5 and 6 can be applied especially conveniently to the opening-closing frame 16 of the automatic document conveying device 4. They can also be applied to an ordinary opening-closing frame which has no document conveying function but is useful for covering a document placed on the transparent plate.

Conveyor Roller Means

Figure 7:
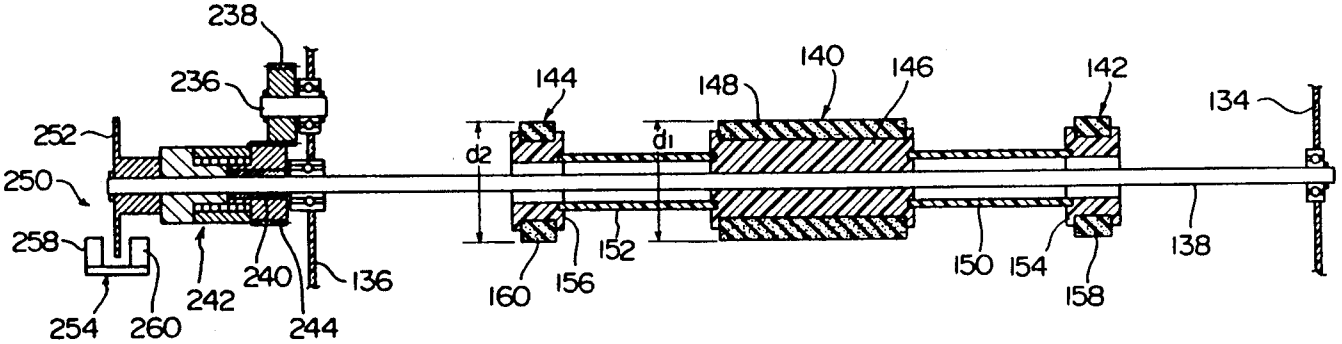
FIG. 7 is a partial sectional view of a conveyor roller means in the automatic document conveying device of FIG. 1.

The conveyor roller means 22 annexed to the opening-closing frame 16, as clearly shown in FIG. 3, is disposed within the left side edge portion 90 of the opening-closing frame 16. With reference to FIG. 7 in conjunction with FIGS. 2 and 3, a front and a rear supporting wall 134 and 136 are formed integrally in the left side edge portion 90 of the opening-closing frame 16. A rotating shaft 138 is rotatably mounted between the front and rear supporting walls 134 and 136. The rotating shaft 138 extends substantially perpendicularly to the pivot axis 19 of the opening-closing frame 16, and when the opening-closing frame 16 is held at the closed position, extends substantially horizontally on one side portion of the transparent plate 8.

As shown in FIGS. 2 and 7, a central roller 140, disposed centrally in the axial direction of the rotating shaft 138, and side rollers 142 and 144, disposed on both sides of the central roller 140, are mounted on the rotating shaft 138. The central roller 140 has a relatively broad width, and is comprised of a base portion 146 fixed to the rotating shaft 138 and a surface layer 148 fixed to the peripheral surface of the base portion 146. The base portion 146 may be formed of a suitable synthetic resin. The surface layer 148 is preferably formed of a flexible material such as a formed synthetic resin. One preferred example of the formed synthetic resin to make the surface layer 148 is formed polyurethane sold under the tradename "EMO" by Inoue MTP Co., Ltd.

Base ends of cantilever supporting members 150 and 152 extending axially are fixed to both side surfaces of the base portion 146 of the central roller 140. The cantilever supporting members 150 and 152 may be of a cylindrical form extending around, and concentric with, the rotating shaft 138, and may be formed of a suitable synthetic resin. The side rollers 142 and 144 are not directly fixed to the rotating shaft, but are fixed to the free ends of the cantilever supporting members 150 and 152 and therefore are supported by the cantilever supporting members 150 and 152. The side rollers 142 and 144 are comprised respectively of cylindrical base portions 154 and 156, fixed to the free ends of the cantilever supporting members 150 and 152, and surface layers 158 and 160. The base portions 154 and 156 may be formed of a suitable synthetic resin, and have an inside diameter much larger than the outside diameter of the rotating shaft 138 so that a sufficient gap exists between them. The surface layers 158 and 160 of the side rollers 142 and 144 are preferably formed of a flexible material such as a formed synthetic resin, as is the surface layer 148 of the central roller 140. It is important that the outside diameter $d_1$ of the central roller 140 should be set such that when the opening-closed frame 16 is at the closing position, the peripheral surface of the central roller 140 is brought into contact with the upper surface of the transparent plate 8. Let the distance between the axis of the rotating shaft 138 and the upper surface of the transparent plate 8 when the opening-closing frame 16 is held at the closed position be l, the outside diameter $d_1$ of the central roller 140 can be set so that it satisfies the equation $d_1/2=l+\alpha$ in which $\alpha$ is about 0.5 to 1.0 mm. On the other hand, the outside diameter $d_2$ of the side rollers 142 and 144 is conveniently larger than the outside diameter $d_1$ of the central roller 140 by about 1.0 to 2.0 mm. When the opening-closing frame 16 is held at the closed position, the side rollers 142 and 144 are brought into intimate contact with the upper surface of the transparent plate 8 with elastic deformation of their surface layers 158 and 160 and the elastic flexing of the cantilever supporting members 150 and 152.

Figure 8:
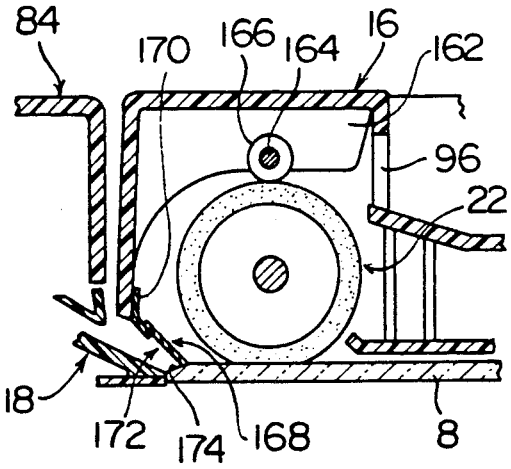
FIG. 8 is a partial sectional view of a guiding means in the automatic document conveying device of FIG. 1.

As shown in FIGS. 3 and 8, a plurality of guiding ribs 162 are provided at suitable intervals in the width direction (the direction perpendicular to the sheet surface in FIG. 3) in the left side edge portion 90 of the opening-closing frame 16 in relation to the conveyor roller means 22. The lower edges of the guiding ribs 162 extend to the left and right nearly along the conveyor roller means 22. A follower roller 166 is rotatably mounted on the guiding ribs 162 by a pin 164. The follower roller 166 projects downwardly beyond the lower edges of the guiding ribs 162, and makes contact with the central roller 140 in the conveyor roller means 22.

Guiding Means

With reference to FIGS. 3 and 8, a guiding means 168, which permits the advancing of the document to the transparent plate 8 from the document table 18 but hampers the movement of the document toward the document table 18 from the transparent plate 8 and deflects it upwardly, is disposed between the conveyor roller means 22 and the delivery end (i.e., the downstream end) of the document table 18 positioned adjacent to it. The guiding means 168 is comprised of a flexible thin piece 172 secured to the inside surface of the left wall of the opening-closing frame 16 via a slender supporting member 170. As clearly depicted in FIG. 8, the supporting member 170 extends in the width direction (the direction perpendicular to the sheet surface in FIG. 8) and is fixed to the inside surface of the left side wall of the opening-closing frame 16. The supporting member 170 may be formed of a suitable plate material such as a copper plate. Its lower end portion is inclined downwardly to the right and projects from the inside surface of the left side wall of the opening-closing frame 16. The thin piece 172 constituting the guiding means 168 is bonded at its upper end portion to the lower end portion of the supporting member 170 and is inclined downwardly to the right (and therefore inclined downwardly in the downstream direction as viewed in the direction of delivering from the document table 18). An inclined surface 174 inclined downwardly to the left is formed in the left side end portion of the transparent plate 8, and the lower end of the thin piece 172 is kept in contact with the inclined surface 174 of the transparent plate 8. As will be described in detail hereinafter, when the document is delivered from the document table 18 toward the surface of the transparent plate 8, it is important that the leading edge of the document should act on the thin piece 172, and the thin piece 172 should bend upwardly. Accordingly, it is important that the thin piece 172 itself should bend relatively easily. The thin piece 172 may be conveniently formed from a suitable synthetic resin film, for example, a polyester film having a thickness of about 0.075 mm. If desired, the thin piece 172 may be formed of a suitable metallic foil. When the thin piece 172 is formed of a conductive metal foil, the thin piece 172 can be grounded and caused to function also as a charge eliminating means for removing an undesirable static charge from the document.

Figure 9:
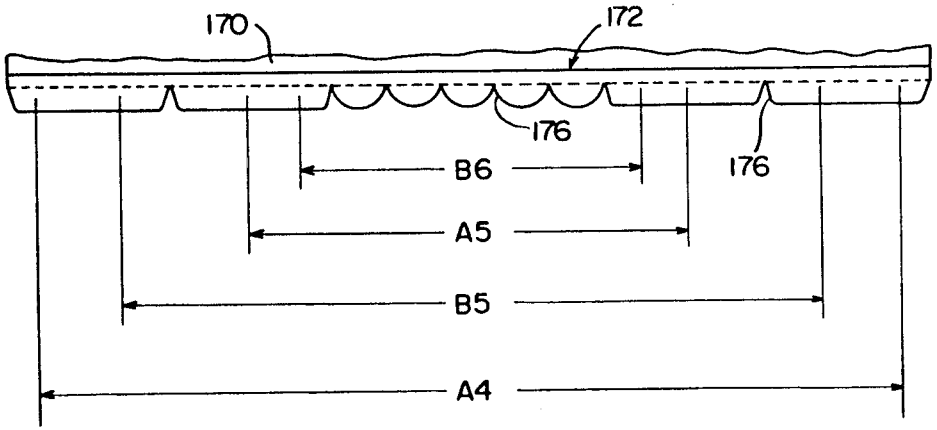
FIG. 9 is a side view showing a guiding means in the automatic document conveying device of FIG. 1.

As shown clearly in FIG. 9, a plurality of recesses 176 are preferably formed in the thin piece 172 at suitable intervals in the width direction. The width positions of the recesses 176 are preferably not in alignment with both side edges of the document of a specified size delivered from the document table 18 but deviate in the width direction with respect to the side edges. In the illustrated embodiment, the document table 18 is designed to deliver documents having width dimensions defined as B6, B5,A5 and A4 by JIS (Japanese Industrial Standards), and as shown in FIG. 9, the recesses 176 formed in the thin piece 172 deviate in the width direction with respect to the two side edges of documents having these various sizes. The recesses 176 facilitate the required flexing of the thin piece 172 by the action of the document delivered from the document table 18. It should also be noted that when a relatively narrow document having a size of, for example, B6 or A5 is delivered from the document table 18, its leading edge acts only on the central portion of the thin piece 172, and when the recesses 176 are absent, the thin piece 172 tends to be bent between its central portion and each side portion. If this bending occurs repeatedly and becomes incessant, a document delivered to the left in FIG. 8 from the transparent plate 10 is likely to abut the lower end of the thin piece 172 and jam up without being deflected upwardly along the thin piece 172. In contrast, in the presence of the recesses 176, both side portions of the thin piece 172 which exist outwardly of the outermost recess 176 continue to be maintained in the initial state without bending during delivering of such a narrow document from the document table 18, as can be seen from FIG. 9. Accordingly, the aforesaid bending can be avoided. On the other hand, when the recesses 176 are formed in alignment with both side edges of the document, both corner portions of the document enter the recesses 176 when the document is delivered to the left in FIG. 8 from the transparent plate 8 and raised along the thin piece 172. This is likely to result in document jamming.

Figure 10:
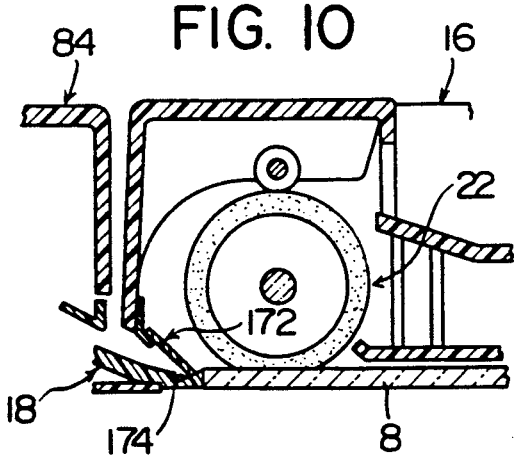
FIGS. 10 and 11 are partial sectional views showing modified examples of the guiding means.

FIG. 10 shows a modified example of the guiding means. In this modified example, the inclined surface 174 is formed in an additional portion annexed integrally to the downstream end of the document table 18 instead of forming the inclined surface 174 in the transparent plate 8 itself. The lower end of the thin piece 172 is kept in contact with this inclined surface 174.

Figure 11:
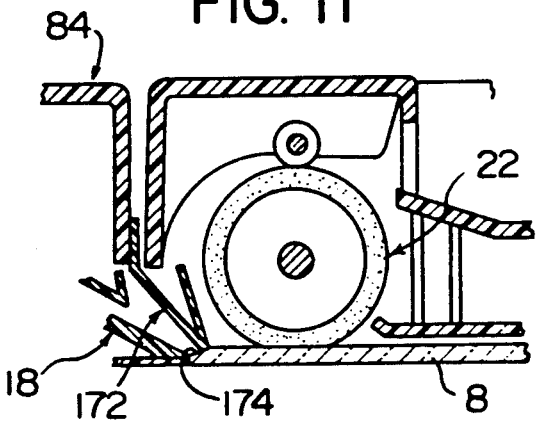

FIG. 11 shows another modified example of the guiding means. In this modified example, the upper end portion of the thin piece 172 is fixed to the outside surface of the cover 84 disposed in the downstream portion of the document table 18. The thin piece 172 has an extension which extends further upwardly from its lower end kept in contact with the inclined surface 174.

Driving Control Means

Figure 12:
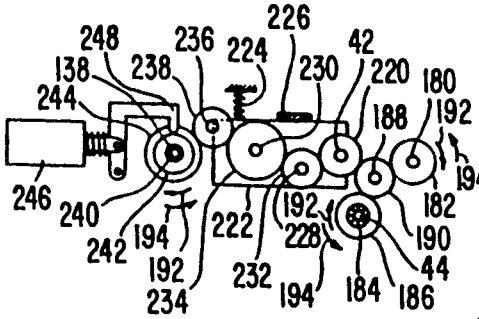
FIGS. 12 and 13 are simplified views schematically showing the driving system in the automatic document conveying device of FIG. 1.
Figure 13:
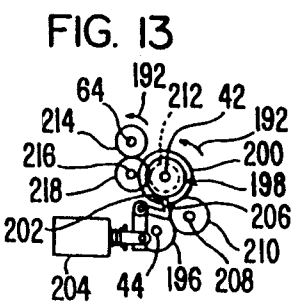

With reference to FIGS. 12 and 13 in conjunction with FIGS. 2 and 4, a reversible electric motor 178 is disposed rearwardly of the rear upstanding plate 34 provided at the back of the downstream portion of the document table 18. The reversible electric motor 178 constitutes a common driving source for the document delivery means 20 and the conveyor roller means 22. A gear 182 is fixed to the output shaft 180 of the motor 178.

A linking means between the reversible motor 178 and the document delivery means 20 will be described. As shown in FIGS. 4 and 12, the rear end portion of the lower rotating shaft 44 to which the reverse-rotating roller 50 is fixed projects rearwardly beyond the rear upstanding plate 34, and a gear 186 is mounted on this rear end portion of the lower rotating shaft 44 via a one-way clutch mechanism 184. A short rod 188 projecting rearwardly is implanted in the rear upstanding plate 34, and an idler gear 190 is rotatably mounted on the short rod 188. The idler gear 190 drivingly connects the gear 182 to the gear 186. When the motor 178 is rotated in a normal direction shown by an arrow 192 and the gear 186 rotates in the direction of arrow 192, the one-way clutch mechanism 184 transmits the rotation of the gear 186 to the lower rotating shaft 44. On the other hand, when the motor 178 is rotated in a reverse direction shown by an arrow 194 and the gear 186 is rotated in the direction of arrow 194, the lower rotating shaft 44 is not rotated. As shown in FIGS. 3 and 13, the front end portion of the lower rotating shaft 44 projects forwardly beyond the front upstanding plate 32, and a gear 196 is fixed to this front end portion of the lower rotating shaft 44. The front end portion of the upper rotating shaft 42, to which the feed roller 46 is fixed, also projects forwardly beyond the front upstanding plate 32, and a gear 200 is mounted on this front end portion of the upper rotating shaft 42 via a solenoid-controlled spring clutch mechanism 198. The spring clutch mechanism 198 is of the type in which one engagement protrusion 202 is formed on the outer circumferential surface of its boss. When a solenoid 204 is instantaneously energized and a control claw 206 is instantaneously released from the engagement protrusion 202, the clutch mechanism 198 connects the gear 200 to the upper rotating shaft 42 through one rotation, namely until the control claw 206 is returned to the original position by the deenergization of the solenoid 204 and is again brought into engagement with the engagement protrusion 202. A forwardly projecting short rod 208 is implanted in the front upstanding plate 32, and an idler gear 210 for drivingly connecting the gear 196 to the gear 200 is rotatably mounted on the short rod 208. Accordingly, when the motor 178 is rotated in a normal direction, the gear 200 is rotated together with the lower rotating shaft 44 to which the reverse-rotating roller 50 is fixed. To the front end portion of the upper rotating shaft 42 is further fixed a gear 212 separate from the clutch mechanism 198 and the gear 200. The front end portion of the cam shaft 64 having the cam 66 fixed thereto also projects forwardly beyond the front upstanding plate 32, and a gear 214 is fixed to this front end portion of the cam shaft 64. A forwardly projecting short rod 216 is also implanted in the front upstanding plate 32, and an idler gear 218 for drivingly connecting the gear 212 to the gear 214 is rotatably mounted on the short rod 216.

With the above structure, when the motor 178 is rotated in the direction of arrow 192, the lower rotating shaft 44 having the reverse-rotating roller 50 fixed thereto is rotated in the direction of arrow 192 (counterclockwise in FIG. 3). In this state, when the solenoid 204 is instantaneously energized, the upper rotating shaft 42 having the feed roller 46 fixed thereto is rotated through one turn in the direction of arrow 192 (counterclockwise in FIG. 3). The rotating of the upper rotating shaft 42 is transmitted to the rotating shaft 54 via the timing belt 62, and therefore, the rotating shaft 54 to which the delivery roller 56 is fixed is also rotated through one turn in the direction of arrow 192 (counterclockwise in FIG. 3). At the same time, the cam shaft 64 to which the cams 66 are fixed is also rotated through one turn in the direction of arrow 192 (counterclockwise in FIG. 3). Hence, the delivery roller 56 is lowered from the elevated position shown in FIGS. 2 and 3, and again returned to the elevated position.

Now, a linking means between the reversible electric motor 178 and the conveyor roller means 22 will be described. As FIGS. 4 and 12 show, the rear end portion of the upper rotating shaft 42 to which the feed roller 46 is fixed projects rearwardly beyond the rear upstanding plate 32. An idler gear 220 is rotatably mounted on this rear end portion of the upper rotating shaft 42, and a supporting plate 222 is pivotally mounted also on it. The idler gear 220 is kept in engagement with the idler gear 190. On the other hand, as schematically shown in FIG. 12, the supporting plate 222 is elastically biased clockwise in FIG. 12 by a tension spring 224 and is elastically held at the illustrated position with which a stationary abutting piece 226 is to abut. Two short rods 228 and 230 are implanted in the supporting plate 222, and idler gears 232 and 234 are rotatably mounted on the short rods 228 and 230. The idler gear 232 is kept in engagement with the idler gears 220 and 234. With reference to FIGS. 2 and 7 together with FIGS. 4 and 12, a rearwardly projecting short rod 236 is implanted in the rear supporting wall 136 formed in the opening-closing frame 16, and an idler gear 238 is rotatably mounted on the short rod 236. When the opening-closing frame 16 is held at the closed position, the idler gear 238 is brought into engagement with the idler gear 234. When at the time of this engagement, the teeth of the two gears 234 and 238 contact each other, the supporting plate 222 is slightly pivoted counterclockwise in FIG. 12. When the two gears 234 and 238 are brought into engagement in the required manner, the supporting plate 222 is returned to the original position by the elastic biasing action of the tension spring 224.

The rear end portion of the rotating shaft 138 of the conveyor roller means 22 projects rearwardly beyond the rear supporting wall 136, and a gear 244 is mounted on this rear end portion of the rotating shaft 138 via a one-way clutch mechanism 240 and a solenoid-controlled spring clutch mechanism 242. This gear 244 is kept in engagement with the idler gear 238. When the motor 178 is reversely rotated in the direction of arrow 194 and the gear 244 is rotated in the direction of arrow 194, the one-way clutch mechanism 240 transmits the rotation of the gear 244 to the rotating shaft 138 and rotates the shaft 138 in the direction shown by arrow 194 (clockwise in FIG. 3). When the motor 178 is rotated normally in the direction of arrow 192 and the gear 244 is rotated in the direction of arrow 192, the rotation of the gear 244 is not transmitted to the rotating shaft 138 via the one-way clutch mechanism 240.

The above spring clutch mechanism 242 is of the type in which a number of engagement protrusions are formed on the outer circumferential surface of its boss. When the solenoid 246 is energized to detach a control claw 248 from the engagement protrusions during the normal rotation of the motor 178 in the direction of arrow 192 and the rotation of the gear 244 in the direction of arrow 192, the spring clutch mechanism 242 transmits the rotation of the gear 244 to the rotating shaft 138 to rotate the rotating shaft 138 in the direction of arrow 192. On the other hand, when the motor 178 is rotated reversely in the direction of arrow 194 and the gear 244 is also rotated in the direction of arrow 194, the boss having the engagement protrusions formed thereon idly rotates in the non-restrained direction. Thus when the solenoid 246 is deenergized and the control claw 248 is held at the operative position, noises occur by the action of the engagement protrusions upon the control claw 248. Accordingly, when the motor 178 is rotated reversely in the direction of arrow 194, the gear 244 is rotated in the direction of arrow 194, and the rotation of the gear 244 is transmitted to the rotating shaft 138 via the one-way clutch mechanism 240, it is desirable to avoid occurrence of the noises by energizing the solenoid 246, irrespective of the transmission of the rotation, and detaching the control claw 248 from the engagement protrusions.

Thus, when the motor 178 is rotated in the direction of arrow 192 and the solenoid 246 is energized, the rotating shaft 138 of the conveyor roller means 22 is rotated in the direction of arrow 192 (counterclockwise in FIG. 3). On the other hand, when the motor 178 is rotated reversely in the direction of arrow 194, the rotating shaft 138 of the conveyor roller means 22 is rotated in the direction of arrow 194 (clockwise in FIG. 3).

As shown in FIGS. 2, 4 and 7, the rotating shaft 138 of the conveyor roller means 22 has annexed thereto a detecting means 250 for detecting the amount of its rotation. The detecting means 250 may be of a known form and is comprised of a rotating plate 252 fixed to the rear end portion of the rotating shaft 138, and a photoelectric rotation detector 254 disposed in relation to the rotating plate 252. A number of holes 256 are formed in the rotating plate 252 at equiangular intervals. The detector 254 has a light emitting element 258 disposed on one side of the rotating plate 252 and a light receiving element 260 disposed on the other side of the rotating plate 252. Every time the rotating plate 252 rotates in the direction of arrow 192 or 194 and one hole 256 passes between the light emitting element 258 and the light receiving element 260, the light receiving element 260 receives light from the light emitting element 258 and produces a pulse.

Operating Procedure

Now, with reference to FIGS. 14-A to 14-F, 15 and 16, the operating procedure of the automatic document conveying device 4 will be described.

Figure 15:
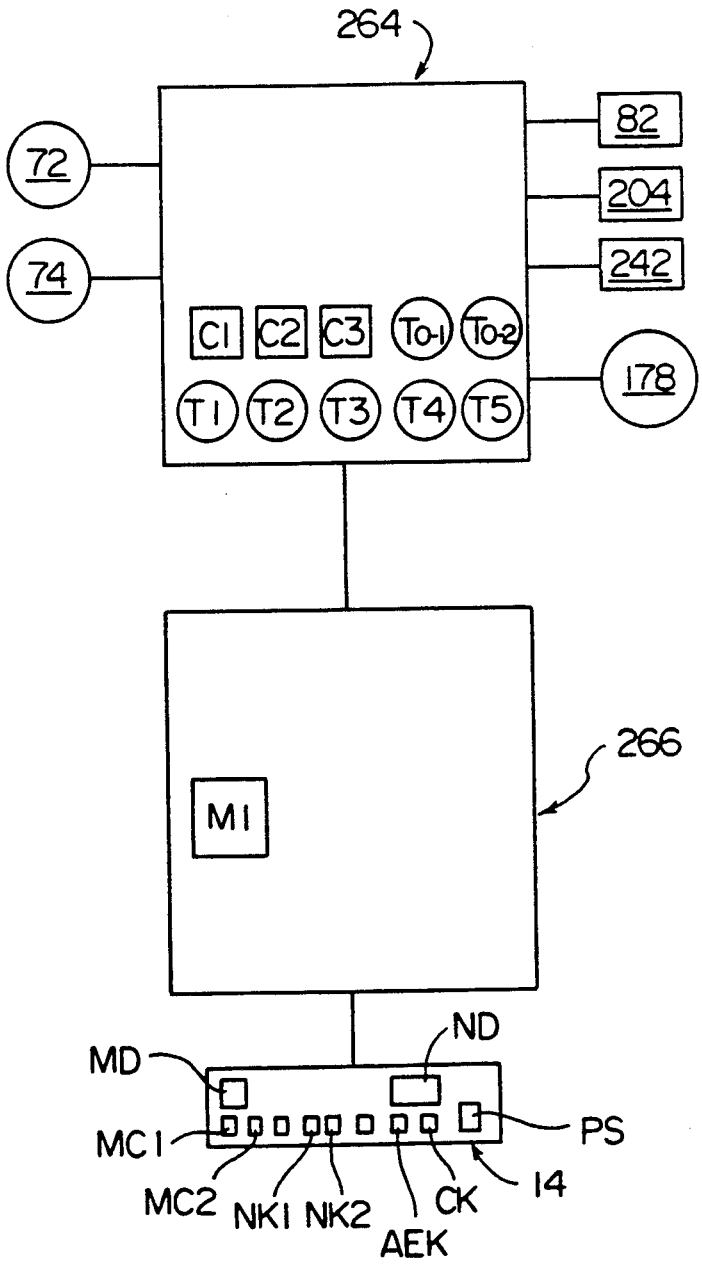
FIG. 15 is a block diagram showing control elements in the automatic document conveying device and the electrostatic copying machine.
Figure 16:
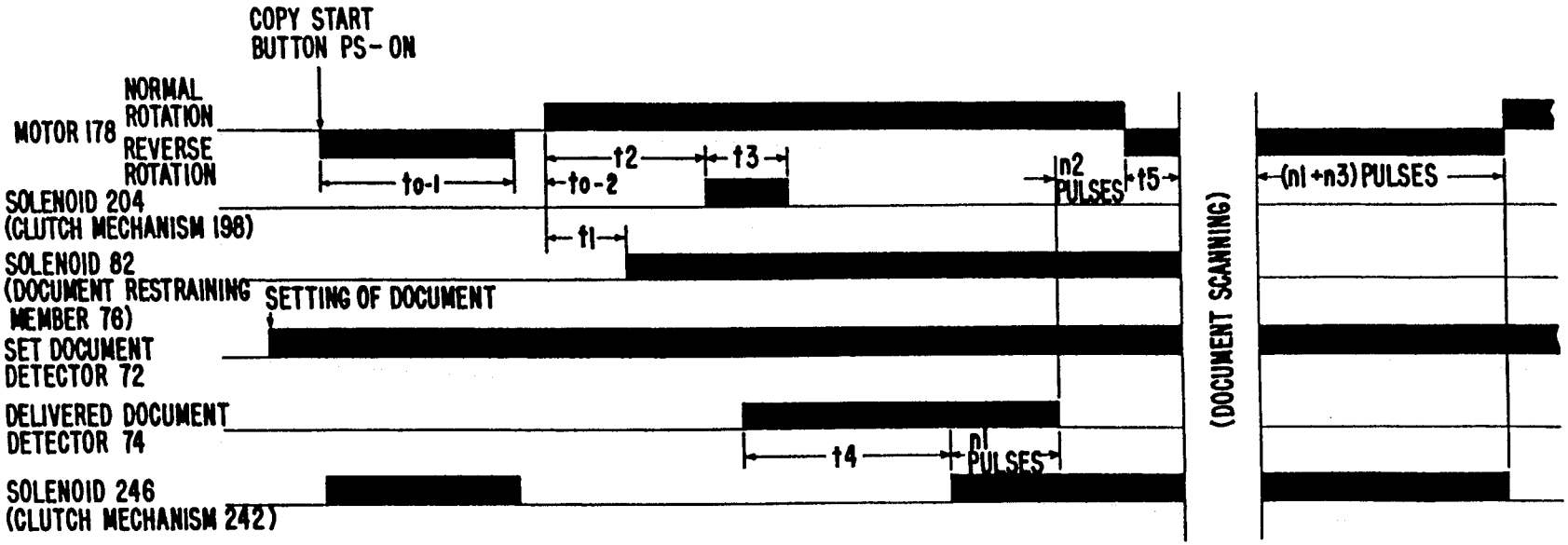
FIG. 16 is a time chart illustrating the operating procedure of the automatic document conveying device of FIG. 1.

When a plurality of sheet-like documents are to be successively copied by using the automatic document conveying device 4, as shown in FIG. 14-A, the sheet-like documents 262 are stacked on the document table 18 with their printed surfaces down, and the forward edges of the documents 262 are brought into contact with, or near to, the oppositely inclined portion 26 of the document table 18. The document restraining member 76 held at the operative position hampers the forward movement of the documents 262 beyond the oppositely inclined portion 26. When the documents 262 are placed in the required manner on the document table 18, the set document detector 72 is actuated. As a result, a controller 264 (FIG. 15) provided in the automatic document conveying device 4, feeds a signal showing the presence of the documents 262 on the document table 18 to a controller 266 provided in the electrostatic copying machine 2. The controllers 264 and 266 may each be constructed of a microprocessor. When the operator then depresses a copy start switch button PS (FIG. 1) on the operating panel 14 of the electrostatic copying machine 2, a signal indicating start of document delivery is fed to the controller 264 from the controller 266. When this signal is produced, the controller 264 starts the reverse rotation of the reversible electric motor 178 (at the same time, the solenoid 246 of the clutch mechanism 242 is energized to avoid occurrence of the noises) prior to document delivery. Thus, the conveyor roller 22 preliminarily begins to rotate clockwise in FIG. 14-A. When a predetermined time $t_{0-1}$ defined by a timer $T_{0-1}$ has elapsed, the motor 178 is deenergized and stops its reverse rotation (the solenoid 246 of the spring clutch mechanism 242 is also deenergized). For example, when the document manually placed on a transparent plate 8 remains on it without being removed, it is delivered to the left in FIG. 14-A by the action of the conveyor roller means 22 while the roller means 22 is preliminarily rotated. The document is deflected upwardly by the guiding means 168, and discharged onto the document receiving surface (namely, the upper surface of the main portion 86 of the opening-closing frame 16) through the discharge opening 96 by the action of the conveyor roller means 22 and the follower roller 166 cooperating with it. The predetermined time $t_{0-1}$ may be set at a time interval required for discharging a document of the largest size that can be placed on the transparent plate 8. If desired, it is possible to provide a detector (not shown) for detecting the delivered document above the guiding means 168 and to stop the preliminary rotation of the conveyor roller means 22 when the detector does not detect the document (and therefore, no document remains on the transparent plate 8) after a time period shorter than the above predetermined time $t_{0-1}$ (corresponding to the time required for the remaining document which has begun to be delivered by the action of the conveyor roller 22 to reach the detector) has elapsed from the time of starting the preliminary rotation of the conveyor roller 22.

When the motor 178 is deenergized and some period of time $t_{0-2}$ defined by a timer $T_{0-2}$ has elapsed from the time when the preliminary rotation of the conveyor roller 22 is stopped, the controller 264 start normal rotation of the motor 178. Then, after a predetermined period of time $t_1$, set by a timer T1 built in the controller 264 (for example, 150 ms), has passed, energization of solenoid 82 is started. As a result, the document restraining member 76 is moved backward to its non-operative position shown in FIG. 14-B from its operative position shown in FIG. 14-A. Furthermore, after a predetermined time $t_2$, set by a timer T2 built in the controller 264 (for example, 300 ms), has passed from the starting of the normal rotation of the motor 178, the solenoid 204 of the spring clutch mechanism 198 is energized instantaneously for a predetermined time $t_3$ set by a timer T3 built in the controller 264. The predetermined time $T_3$ may be about 150 ms. When the solenoid 204 is instantaneously energized, the cam shaft 64 to which the cams 66 are fixed is rotated counterclockwise in FIGS. 14-A and 14-B to lower the delivery roller 56 from its elevated position shown in FIG. 14-A to its lowered position shown in FIG. 14-B and bring roller 56 into contact with the uppermost document 262 of the stack of documents 262. At the same time, the delivery roller 56 is rotated counterclockwise in FIG. 14-B and the feed roller 46 and the reverse rotating roller 50 are rotated counterclockwise in FIG. 14-B. As a result, the uppermost document 262 on the document table 18 is delivered downstream (to the right in FIG. 14-B), and the delivered document 262 is further fed downstream by the feed roller 46. The reverse-rotating roller 50 prevents two or more documents 262 from being fed simultaneously. The delivered document 262 actuates the delivered document detector 74, and then its leading edge abuts with the intimately contacting site between the transparent plate 8 and the rollers 140, 142 and 144 of the conveyor roller means 22 which is still in a non-operative state (out of operation). When the leading edge of the document 262 delivered from the document table 18 is inclined as viewed in the width direction, its inclination is remedied by the above abutment. Since as stated above the solenoid 204 is energized only instantaneously, the delivery roller 56 and the feed roller 46 stop after one rotation. In the meantime, the reverse-rotating roller 50 continues to rotate. The cam shaft 64 stops after one rotation. Hence, as shown in FIG. 14-C, the delivery roller 56 is again returned to the elevated position. The amount of feeding of the document 262 by one rotation of the feed roller 46 is set at a value slightly larger than the amount of feeding required to advance the leading edge of the document 262 to the aforesaid intimately contacting site between the transparent plate 8 and the rollers 140, 142 and 144. Accordingly, the inclination of the document 262 can be exactly corrected. At this point, the trailing end of the document 262 still is between the feed roller 46 and the reverse-rotating roller 50. The feed roller 46 is at a stop at such an angular position that the cut 48 formed on its outer circumferential surface is directed downwardly, and does not act on the document 262. Hence, the above correction of the inclination of the document 262 is not obstructed by the feed roller 46 and the reversely rotating roller 50.

When a predetermined time $t_4$ has elapsed from the closing of the delivered document detector 74 by the delivered document 262, the solenoid 246 of the spring clutch mechanism 242 is energized. The predetermined time $t_4$, set by a timer T4 built in the controller 264, is set so that the solenoid 246 is energized after some delay from the time when the feed roller 46 is stopped after one turn. When the solenoid 246 is energized, the conveyor roller means 22 begins to be rotated counterclockwise in FIGS. 14-C and 14-D, and the document 262 begins to be introduced onto the transparent plate 8. As stated above, at this point of time, the rear portion of the document 262 still is between the feed roller 46 and the reverse-rotating roller 50, but the feed roller 46 is at a stop at such an angular position that the cut 48 formed on its outer circumferential surface faces downwardly and does not act on the document 262. Accordingly, the above introduction of the document 262 is not hampered by the feed roller 46 and the reverse rotating roller 50. When the introduction of the document 262 proceeds by the conveyor roller means 22, the trailing edge of the document 262 goes past the delivered document detector 74, and therefore the detector 74 is deactuated, as shown in FIG. 14-D. A counter C1 built in the controller 264 counts the number of pulses produced by the photoelectric rotating detector 254 from the time when the solenoid 246 is energized and the conveyor roller means 22 begins to be rotated clockwise in FIG. 14-D to the time when the delivered document detector 74 is deactuated and maintains this counted value $n_1$ until the counter is reset in order to count the number of pulses again with respect to the next document. The counted value $n_1$ maintained by the counter C1 corresponds to the length of the document 262 that has been introduced. The counted value $n_1$ is large when the document 262 is long and is small when the document 262 is short. Another counter C2 is built in the controller 264 starts to count the number of pulses produced by the photoelectric rotation detector 254 from the time when the delivered document detector 74 is deactuated. When the counted value of the counter C2 reaches a predetermined value $n_2$ (for example, 50), the supply of voltage for rotating the motor 178 in the normal direction is stopped. Simultaneously, voltage for rotating the motor 178 reversely is supplied only for a very short period of time $t_5$ set by a timer T5 built in the controller 264. The solenoid 246 is deenergized as soon as the reverse rotation of the motor 178 stops. The supply of voltage to the motor 178 for reverse rotation for a short time $t_5$ of, for example, about 27 ms applies a braking action on the motor 178, which has so far rotated in the normal direction, to prevent idler running of the motor 178 by inertia and to stop the normal rotation of the motor 178 precisely at the required point of time. When the normal rotation of the motor 178 stops, the introduction of the document 262 is over. As shown in FIG. 14–E, it is important that the trailing edge of the introduced document 262 should be held between the transparent plate 8 and the rollers 140, 142 and 144 of the conveyor roller means 22, and precisely in agreement with a standard position of scanning and exposure on one edge portion of the transparent plate 8. The predetermined counted value $n_2$ defining the time of starting the reverse rotation of the motor 178 for the very short period $t_5$ after stopping of its normal rotation is stored in a variable memory M1 built in the controller 266 of the electrostatic copying machine 2 and is fed to the controller 264 of the automatic document conveying device 4 (this will be described further hereinafter).

When the introduction of the document 262 is over, a copying process in the electrostatic copying machine 2 is started and the introduced document on the transparent plate 8 is optically scanned. When the optical scanning of the document is terminated, a signal is fed from the controller 266 of the electrostatic copying machine 2 to the controller 264 of the automatic document conveying device 4. As a result, the controller 264 starts reverse rotation of the motor 178, and simultaneously the solenoid 246 is energized to avoid occurrence of noises. Thus, the conveyor roller means 22 begins to rotate clockwise in FIGS. 14-E and 14-F. As a result, the document 262 is delivered to the left in FIG. 14-F from the transparent plate 8, deflected upwardly by the guiding means 168, and discharged onto the document receiving surface (the upper surface of the main portion 86 of the opening-closing frame 16) through the discharge opening 96 by the action of the conveyor roller means 22 and the follower roller 166 cooperating with it. When the reverse rotation of the motor 178 is started as above, the counter C3 built in the controller 264 begins to count pulses produced by the photoelectric rotation detector 254. When the counted value of the counter C3 reaches a value equaling the counted value $n_1$ maintained by the counter C1 plus a predetermined value $n_3$, the reverse rotation of the motor 178 is stopped. The counted value $n_1$, maintained by the counter C1, corresponds to the length of the introduced document 262 as stated above, and the predetermined value $n_3$ is set at the smallest value required for document delivery. Hence, the motor 178 is reversely rotated only for the minimum required period of time according to the length of the introduced document 262, and the wasteful consumption of power and time by the unnecessary reverse rotation of the motor 178 can be circumvented.

When the next document 262 exists on the document table 18 and the set document detector 72 is actuated after discharging the document 262 as above, the rotation of the motor 178 in the normal direction is automatically started and the delivery of the next document 262 is also started. The above operating procedure is then repeated.

The introduced position of the document 262, which should be precisely set as described above, depends upon the predetermined value $n_2$ stored in the variable memory M1 built in the controller 266 of the electrostatic copying machine 2. When it is desired to change the predetermined value $n_2$ for microadjustment or the intentional change of document positioning, switches or keys disposed on the operating panel 14 of the electrostatic copying machine 2 are operated, for example, in the following manner.

First, a clear key CK and the copy start button PS are depressed simultaneously. As a result, the controller 266 is in condition for accepting changes in the numerals set in the various memories. Then, by operating copy number setting keys NK1 and NK2, a simulation number, for example "87", for changing the predetermined value $n_2$ is selected so that the number "87" is displayed on a copy number displayer ND. Thus, the code "d" of the predetermined number $n_2$ and its memorized number, for example "50", are displayed on a copy magnification displayer MD. Then, by operating copy magnification change keys MC1 and MC2, the number "50" is changed to the desired number and thus, the number stored in the memory M1 is changed. When the clear key CK and the copy start button PS are then depressed simultaneously, the electrostatic copying machine 2 is returned to a normal state.

In the illustrated embodiment, the above predetermined value $n_2$ is stored in the memory M1 built in the controller 266 of the electrostatic copying machine 2 and is fed into the controller 264 of the automatic document conveying device 4. Accordingly, without the need to provide switches and keys and displayers additionally for exclusive use, the predetermined value $n_2$ can be changed easily by utilizing the switches and keys and displayers disposed on the operating panel 14 of the electrostatic copying machine 2. If the predetermined value $n_2$ is stored in a memory of the controller 264 of the automatic document conveying device 4, various switches and keys and displayers must be provided additionally in the automatic document conveying device 4 in order to permit changing of the predetermined value $n_2$. This leads to increased cost of constructing the automatic document conveying device 4.

While the present invention has been described with reference to preferred embodiments of the automatic document conveying device of the invention shown in the accompanying drawings, it should be understood that the invention is not limited to these preferred embodiments alone, and various changes and modifications are possible without departing from the scope of the invention.

We claim:

1. An automatic document conveying device for use with an image processing machine having a housing, with a transparent plate, on which to place documents, disposed on the upper surface of the housing, said device comprising:

an opening-closing frame adapted to be mounted on the housing so that the opening-closing frame is free to pivot around a pivot axis extending along one edge of the transparent plate between a closed position at which the opening-closing frame covers the transparent plate and an open position at which the transparent plate is exposed to view, conveyor roller means rotatably mounted within the opening-closing frame to be brought into intimate contact with the transparent plate when the opening-closing frame is in the closed position, a document table adapted to be mounted on the housing adjacent to the opening-closing frame, document delivery means for delivering sheet-like documents on the document table one by one in a document delivery direction toward the transparent plate, and control means for controlling actuation of the conveyor roller means and the document delivery means, and, in an inoperative state of the conveyor roller means, operative to initiate actuation of the document delivery means to deliver the document in the document delivery direction from the document table toward the transparent plate, said control means responsive to the leading edge of the delivered document abutting the site of intimate contact between the transparent plate and the conveyor roller means in the inoperative state of the conveyor roller means for stopping actuation of the document delivery means and rotating the conveyor roller means in a document delivery direction to move the delivered document in the document delivery direction to a required position on the transparent plate.

2. The automatic document conveying device of claim 1, in which:

the opening-closing frame has a document discharge opening disposed therein adjacent the conveyor roller means, said device further comprises guiding means adapted to be disposed between the document table and the conveyor roller means to permit the advancing of the document in the document delivery direction to the transparent plate from the document table but to hamper the movement of the document from the transparent plate to the document table in a carrying direction opposite the document delivery direction and to deflect the document upwardly, and the control means includes means for stopping rotation of the conveyor roller means in the document delivery direction while the document introduced by the rotation of the conveyor roller means in the document delivery direction is between the conveyor roller means and the transparent plate, and means responsive to termination of scanning of the introduced document for rotating the conveyor roller means in a carrying direction to move the document in the carrying direction to cause the scanned document to be deflected upwardly by the guiding means and conveyed to the opening-closing frame through the discharge opening.

3. The automatic document conveying device of claim 2 in which the control means includes means for preliminarily rotating the conveyor roller means in the carrying direction prior to actuation of the document delivery means, and after stopping of the preliminary rotation of the conveyor roller means in the carrying direction, starting actuation of the document delivery means to deliver the document in the document delivery direction from the document table to the transparent plate.

4. The automatic document conveying device of claim 3 in which the means for preliminarily rotating the conveyor roller means in the carrying direction includes timing means for deactivating said means for preliminarily rotating the conveyor roller means after a predetermined period of time.

5. The automatic document conveying device of claim 2 in which the guiding means comprises a flexible thin piece which projects downwardly inclinedly in the downstream direction as viewed in the direction of delivering the document from the document table.

6. The automatic document conveying device of claim 5 in which the thin piece has a plurality of recesses formed therein in spaced-apart relationship in the width direction.

7. The automatic document conveying device of claim 6 in which the recesses are disposed so that they are positioned in the width direction at positions different from the positions of both side edges of documents of various standard sizes which can be delivered from the document table.

8. The automatic document conveying device of claim 5 in which the thin piece is formed of a synthetic resin film.

9. The automatic document conveying device of claim 5 in which the thin piece is formed of an electrically conductive metal foil.

10. The automatic document conveying device of claim 5 adapted for mounting on and use with an image processing machine in which a surface inclined downwardly in the document delivery direction is formed in the upstream end portion of the transparent plate as viewed in the document delivery direction, and in which said guiding means further comprises means for keeping the lower end of the thin piece in contact with the inclined surface.

11. The automatic document conveying device of claim 2 in which:

the control means includes a common driving source including a reversible electric motor, first linking means for linking the common driving source and the document delivery means, and second linking means for linking the common driving source and the conveyor roller means, the first linking means includes a first one-way clutch mechanism, a first solenoid-controlled spring clutch mechanism, and means responsive to the first solenoid-controlled spring clutch mechanism being brought into operation while the common driving source is rotating in a normal direction for transmitting the rotation of the common driving source in the normal direction to the document delivery means via the first one-way clutch mechanism and the first solenoid-controlled spring clutch mechanism to delivery sheet-like documents in the document delivery direction, and the second linking means includes a second one-way clutch mechanism, a second solenoid-controlled spring clutch mechanism, and means responsive to the second solenoid-controlled spring clutch mechanism being brought into operation while the common driving source is rotating in the normal direction for transmitting the rotation of the common driving source in the normal direction to the conveyor roller means via the second solenoid-controlled spring clutch mechanism to rotate the conveyor roller means in the document delivery direction, and responsive to the common driving source rotating in a reverse direction for transmitting the rotation of the common driving source in the reverse direction to the conveyor roller means via the second one-way clutch mechanism to rotate the conveyor-roller means in the carrying direction.

12. The automatic document conveying device of claim 11 in which said control means includes means responsive to the common driving source rotating in the reverse direction for maintaining the second solenoid-controlled spring clutch mechanism in operation to avoid occurrence of noises.

13. The automatic document conveying device of claim 2 in which the control means includes means for determining the length of the introduced document, and means responsive to the length of the introduced document for setting the time for stopping the rotation of the conveyor roller means in the carrying direction after the scanning of the introduced document.

14. The automatic document conveying device of claim 13 in which the control means includes:

a document detector disposed upstream of the conveyor roller means as viewed in the document delivery direction from the document table, and means responsive to the introduced length of the document, as determined from the time of rotating of the conveyor roller means in the document delivery direction until the document detector detects the trailing edge of the introduced document, for setting the time for stopping the rotation of the conveyor roller means in the carrying direction after the scanning of the introduced document.

15. The automatic document conveying device of claim 14 in which the control means includes a rotation plate for rotating with the conveyor roller means, a photoelectric rotating detector for producing pulses according to the rotation of the rotation plate when the conveyor roller means is rotated, means for detecting the introduced length of the document based on the number of pulses produced by the photoelectric rotating detector, and means for setting the time for stopping the rotation of the conveyor roller means in the carrying direction based on the number of pulses produced by the photoelectric rotating detector.

16. The automatic document conveying device of claim 1 in which the conveyor roller means is disposed such that its axis of rotation extends along one side portion of the inside of the opening-closing frame substantially perpendicular to the pivot axis, and the document table is disposed such that the delivery end thereof is adjacent the conveyor roller means.

17. The automatic document conveying device of claim 1 in which the conveyor roller means includes a rotating shaft and a plurality of rollers mounted on the rotating shaft, and at least the surface layers of the rollers are formed of a flexible material.

18. The automatic document conveying device of claim 17 in which the conveyor roller means includes a central roller disposed centrally in the direction of the axis of rotation and two side rollers disposed on both sides of the central roller in a spaced-apart relationship in the direction of the axis of rotation, and elastic mounting means for elastically mounting each of the side rollers on the rotating shaft so as to be displaceable elastically in the radial direction.

19. The automatic document conveying device of claim 18 in which:

the conveyor roller means further includes means for fixing the central roller to the rotating shaft, cantilever supporting members, means for fixing the cantilever supporting members to both side portions of the central roller and extending along the axis of rotation of the central roller, the elastic mounting means fix each of the side rollers to the free end of a respective one of the cantilever supporting members, and the cantilever supporting members are adapted to bend to elastically displace each of the side rollers in the radial direction.

20. The automatic document conveying device of claim 19 in which each of the cantilever supporting members is of a cylindrical shape surrounding the rotating shaft and extending concentrically therewith.

21. The automatic document conveying device of claim 18 in which the outside diameter of each of the side rollers is slightly larger than the outside diameter of the central roller.

22. The automatic document conveying device of claim 17 in which the surface layers of the rollers of the conveyor roller means are formed of a foamed synthetic resin.

23. The automatic document conveying device of claim 1 in which the control means includes;

a document detector disposed upstream of the conveyor roller means as viewed in the document delivery direction from the document table, a rotation plate for rotating with the conveyor roller means, a photoelectric rotating detector for producing pulses according to the rotation of the rotation plate when the conveyor roller means is rotated, means responsive to the photoelectric rotating detector producing a predetermined number of pulses from the time that the trailing edge of the document introduced by the rotation of the conveyor roller means in the document delivery direction is detected by the document detector, for stopping the rotation of the conveyor roller means in the document delivery direction, and means for recording the predetermined number of pulses produced by the photoelectric rotation detector in a variable memory provided in the image processing machine.

24. The automatic document conveying device of claim 23 in which the control means includes a reversible electric motor for driving the conveyor roller means, and means operative substantially as soon as the supply of voltage to the reversible electric motor for rotating the conveyor roller means in the document delivery direction is stopped, for supplying voltage to the reversible electric motor for rotating the conveyor roller means in the carrying direction for a very short period of time to stop rotation of the reversible motor in the document delivery direction.

25. The automatic document conveying device of claim 1 further comprising:

a mounting mechanism adapted for mounting the opening-closing frame on the housing, the mounting mechanism including:

a mounting member having extending from the under surface thereof a downwardly extending insertion rod with an adjusting screw fitted thereto, and a pivot member linked pivotally to the mounting member and connected to the opening-closing frame, the mounting member being adapted to be mounted on the housing by inserting the insertion rod for free elevating or lowering thereof into an insertion hole in the upper surface of the housing, and abutting the lower end of the adjusting screw with the upper surface of the housing, whereby, by adjusting the degree of screwing of the adjusting screw on the mounting member, the height of the mounting of the opening-closing frame with respect to the upper surface of the housing can be adjusted.

26. The automatic document conveying device of claim 25 including two of said mounting mechanisms disposed in spaced-apart relationship in the direction of the pivot axis.

27. The automatic document conveying device of claim 25 further comprising:

safety switch means disposed for detecting the opening and closing of the opening-closing frame, the safety switch means including a switch element and an actuating piece for acting on the switch element, one of the switch element and the actuating piece being fixed to the opening-closing frame or the pivot member, and the other of the switch element and the actuating piece being adapted to be elevated or lowered in accordance with the elevating and lowering of the mounting member.

28. The automatic document conveying device of claim 27 in which the other of the switch element and the actuating piece is fixed to the mounting member.

29. The automatic document conveying device of claim 27 in which the other of the switch element and the actuating piece is mounted on the housing for free elevating or lowering thereof and in which said safety switch includes elastic biasing means for elastically biasing said other so that said other partly abuts the mounting member.

30. An automatic document conveying device for use with an image processing machine having a housing, with a transparent plate, on which to place documents, disposed on the upper surface of the housing, said device comprising:

an opening-closing frame adapted to be mounted on the housing so that the opening-closing frame is free to pivot around a pivot axis extending along one edge of the transparent plate between a closed position at which the opening-closing frame covers the transparent plate and an open position at which the transparent plate is exposed to view, conveyor roller means rotatably mounted within the opening-closing frame to be brought into intimate contact with the transparent plate when the opening-closing frame is in the closed position, a document table adapted to be mounted on the housing adjacent the opening-closing frame, document delivery means for delivering sheet-like documents on the document table one by one toward the transparent plate, the opening-closing frame having a document discharge opening disposed therein adjacent the conveyor roller means, guiding means adapted to be disposed between the document table and the conveyor roller means to permit the advancing of the document in a document delivery direction from the document table to the transparent plate but to hamper the movement of the document from the transparent plate to the document table in a carrying direction opposite the document delivery direction and to deflect the document upwardly, and control means for controlling the actuation of the conveyor roller means and the document delivery means, said control means including means for preliminarily rotating the conveyor roller means in the carrying direction, and after stopping the preliminary rotation of the conveyor roller means in the carrying direction, starting the actuation of the document delivery means to deliver the document in the document delivery direction from the document table to the transparent plate.

31. The automatic document conveying device of claim 30 in which the means for preliminarily rotating the conveyor roller means in the carrying direction includes timing means for deactivating said means for preliminarily rotating the conveyor roller means after a predetermined period of time.

32. An automatic document conveying device for use with an image processing machine having a housing, with a transparent plate, on which to place documents, disposed on the upper surface of the housing, said device comprising:

an opening-closing frame adapted to be mounted on the housing so that the opening-closing frame is free to pivot around a pivot axis extending along one edge of the transparent plate between a closed position at which the opening-closing frame covers the transparent plate and an open position at which the transparent plate is exposed to view, conveyor roller means rotatably mounted within the opening-closing frame to be brought into intimate contact with the transparent plate when the opening-closing frame is in the closed position, a document table adapted to be mounted on the housing adjacent the opening-closing frame, document delivery means for delivering sheet-like documents on the document table one by one in a document delivery direction toward the transparent plate, guiding means adapted to be disposed between the document table and the conveyor roller means to permit the advancing of the document in a document delivery direction from the document table to the transparent plate but to hamper the movement of the document from the transparent plate to the document table in a carrying direction opposite the document delivery direction and to deflect the document upwardly, the opening-closing frame having a document discharge opening disposed therein adjacent the conveyor roller means and the guiding means, and control means for controlling the actuation of the conveyor roller means and the document delivery means, wherein:

the control means includes a common driving source including a reversible electric motor, first linking means for linking the common driving source and the document delivery means, and second linking means for linking the common driving source and the conveyor roller means, the first linking means includes a first one-way clutch mechanism, a first solenoid-controlled spring clutch mechanism, and means responsive to the first solenoid-controlled spring clutch mechanism being brought into operation while the common driving source is rotating in a normal direction for transmitting the rotation of the common driving source in the normal direction to the document delivery means via the first one-way clutch mechanism and the first solenoid-controlled spring clutch mechanism to deliver sheet-like documents in the document delivery direction, and the second linking means includes a second one-way clutch mechanism, a second solenoid-controlled spring clutch mechanism, and means responsive to the second solenoid-controlled spring clutch mechanism being brought into operation while the common driving source is rotating in the normal direction for transmitting the rotation of the common driving source in the normal direction to the conveyor roller means via the second solenoid-controlled spring clutch mechanism to rotate the conveyor roller means in the document delivery direction, and responsive to the common driving source rotating in a reverse direction for transmitting the rotation of the common driving source in the reverse direction to the conveyor roller means via the second one-way clutch mechanism to rotate the conveyor roller means in the carrying direction.

33. The automatic document conveying device of claim 32 in which said control means includes means responsive to the common driving source rotating in the reverse direction for maintaining the second solenoid-controlled spring clutch mechanism in operation to avoid occurrence of noises.

34. An automatic document conveying device for use with an image processing machine having a housing, with a transparent plate, on which to place documents, disposed on the upper surface of the housing, said device comprising:

an opening-closing frame adapted to be mounted on the housing so that the opening-closing frame is free to pivot around a pivot axis extending along one edge of the transparent plate between a closed position at which the opening-closing frame covers the transparent plate and an open position at which the transparent plate is exposed to view, conveyor roller means rotatably mounted within the opening-closing frame to be brought into intimate contact with the transparent plate when the opening-closing frame is in the closed position, a document table adapted to be mounted on the housing adjacent the opening-closing frame, document delivery means for delivering sheet-like documents on the document table one by one in a document delivery direction toward the transparent plate, guiding means adapted to be disposed between the document table and the conveyor roller means to permit the advancing of the document in the document delivery direction from the document table to the transparent plate but to hamper the movement of the document from the transparent plate to the document table in a document carrying direction opposite the document delivery direction and to deflect the document upwardly, the opening-closing frame having a document discharge opening disposed therein adjacent the conveyor roller means and the guiding means, and control means for controlling the actuation of the conveyor roller means and the document delivery means, and including means for actuating the document delivery means to deliver a document from the document table, means for rotating the conveyor roller means in a document delivery direction to introduce the delivered document onto the transparent plate, means for stopping the rotation of the conveyor roller means in the document delivery direction while the introduced document is still nipped between the conveyor roller means and the transparent plate, and means responsive to completion of the scanning of the introduced document for rotating the conveyor roller means in the carrying direction to move the introduced document in the carrying direction for a time set according to the length of the introduced document, to cause the guiding means to deflect the scanned document upwardly so that the scanned document is transported through the discharge opening.

35. The automatic document conveying device of claim 34 in which the control means includes:

a document detector disposed upstream of the conveyor roller means as viewed in the document delivery direction from the document table, and means responsive to the introduced length of the document, as determined from the time of rotating of the conveyor roller means in the document delivery direction until the document detector detects the trailing edge of the introduced document, for setting the time for stopping the rotation of the conveyor roller means in the carrying direction after scanning of the introduced document.

36. The automatic document conveying device of claim 35 in which the control means includes a rotation plate for rotating with the conveying means, a photoelectric rotating detector for producing pulses according to the rotation of the rotation plate when the conveyor roller means is rotated, means for detecting the introduced length of the document based on the number of pulses produced by the photoelectric rotating detector, and means for setting the time for stopping the rotation of the conveyor roller means in the carrying direction based on the number of pulses produced by the photoelectric rotating detector.

37. An automatic document conveying device for use with an image processing machine having a housing, with a transparent plate, on which to place documents, disposed on the upper surface of the housing, said device comprising:

an opening-closing frame adapted to be mounted on the housing so that the opening-closing frame is free to pivot around a pivot axis extending along one edge of the transparent plate between a closed position at which the opening-closing frame covers the transparent plate and an open position at which the transparent plate is exposed to view, conveying means rotatably mounted within the opening-closing frame to be brought into intimate contact with the transparent plate when the opening-closing frame is in the closed position, a document table adapted to be mounted on the housing adjacent the opening-closing frame, document delivery means for delivering sheet-like documents on the document table one by one in a document delivery direction toward the transparent plate, and control means for controlling actuation of the conveyor roller means and the document delivery means, and including:

a document detector disposed upstream of the conveying means as viewed in the document delivery direction from the document table, pulse producing means for producing pulses whenever the conveying means is rotated, means for actuating the document delivery means to deliver the document from the document table, means for rotating the conveying means in the document delivery direction to introduce the delivered document onto the transparent plate, means responsive to the pulse producing means having produced a predetermined number of pulses from the time that the trailing edge of the introduced document is detected by the document detector, for stopping the rotation of the conveying means in the document delivery direction, and means for recording the predetermined number of pulses produced by the pulse producing means in a variable memory provided in the image processing machine.

38. The automatic document conveying device of claim 37 in which the means for rotating includes a reversible electric motor for driving the conveyor means, and means operative substantially as soon as supplying of voltage to the reversible electric motor for rotating the conveying means in the document delivery direction is stopped, for supplying voltage to the reversible motor for rotating the conveying means in a document carrying direction opposite the document delivery direction for a very short period of time to stop rotation of the reversible electric motor in the document delivery direction.

39. A sheet material guiding member which permits movement of sheet material along a given surface in a given direction but hampers movement of the sheet material along the given surface in a direction opposite the given direction and deflects the sheet material upwardly from the given surface, said guiding member comprising a flexible thin piece projecting inclinedly downwardly in the given direction with the lower end thereof kept in contact with the given surface, the flexible thin piece having a plurality of recesses positioned along the lower end thereof at non-uniformly spaced positions different in the width direction from the positions of both side edges of sheet materials of various standard sizes to be moved in the given direction along the given surface.

40. The sheet material guiding member of claim 39 in which the thin piece is formed of a synthetic resin film.

41. The sheet material guiding member of claim 39 in which the thin piece is formed of an electrically conductive metal foil.

* * * * *

UNITED STATES PATENT AND TRADEMARK OFFICE

CERTIFICATE OF CORRECTION

PATENT NO. : 5,058,874

DATED : October 22, 1991

INVENTOR(S) : Jun MIYOSHI, et al.

It is certified that error appears in the above-identified patent and that said Letters Patent is hereby corrected as shown below:

On the title page under "Foreign Application Priority Data" correct the first date shown from "Mar. 12, 1988 [JP] Japan ..... 63-174135" to read:

--Jul. 12, 1988 [JP] Japan .....63-174135--.

Signed and Sealed this

Twenty-ninth Day of June, 1993

Michael K. Kirk

MICHAEL K. KIRK

*Acting Commissioner of Patents and Trademarks*

*Attest:*

*Attesting Officer*